US012467121B2

(12) United States Patent
Maki et al.

(10) Patent No.: US 12,467,121 B2
(45) Date of Patent: Nov. 11, 2025

(54) GALVANIZED STEEL SHEET

(71) Applicant: NIPPON STEEL CORPORATION, Tokyo (JP)

(72) Inventors: Jun Maki, Tokyo (JP); Keitaro Matsuda, Tokyo (JP); Hiroyuki Kawata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 45 days.

(21) Appl. No.: 18/290,088

(22) PCT Filed: May 10, 2021

(86) PCT No.: PCT/JP2021/017739

§ 371 (c)(1),
(2) Date: Nov. 9, 2023

(87) PCT Pub. No.: WO2022/239071

PCT Pub. Date: Nov. 17, 2022

(65) Prior Publication Data

US 2024/0247357 A1 Jul. 25, 2024

(51) Int. Cl.
*C23C 2/40* (2006.01)
*C21D 6/00* (2006.01)
(Continued)

(52) U.S. Cl.
CPC ..... *C23C 2/40* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C21D 9/46* (2013.01);
(Continued)

(58) Field of Classification Search
CPC ..... C23C 2/40; C23C 2/06; C22C 38/001; C22C 38/002; C22C 38/005; C22C 38/02; C22C 38/04; C22C 38/06; C22C 38/08; C22C 38/12; C22C 38/14; C22C 38/16; C22C 38/22; C22C 38/38
USPC ..... 428/607
See application file for complete search history.

(56) References Cited

U.S. PATENT DOCUMENTS 10,953,631 B2 3/2021 Morishita et al.
2015/0232977 A1 8/2015 Sato et al.
(Continued)

FOREIGN PATENT DOCUMENTS

EP 3 725 904 A1 10/2020
JP 2010-65269 A 3/2010
(Continued)

*Primary Examiner* — Katherine A Christy
(74) *Attorney, Agent, or Firm* — Birch, Stewart, Kolasch & Birch, LLP

(57) ABSTRACT

A galvanized steel sheet comprising a steel sheet containing C: 0.05 to 0.30%, Si: 0.01 to 3.00%, Mn: 0.80 to 3.00%, and Al: 0.010 to 2.000% and having a thickness of 0.10 to 0.95 mm, and a galvanized layer on the steel sheet, wherein a tensile strength is 550 to 1500 MPa, and, when defining a thickness of an internal oxide layer per surface of the steel sheet as "A" (μm), a thickness of a decarburized layer per surface of the steel sheet as "B" (μm), and a thickness of the steel sheet as "t" (μm), A/B: 0.01 to 0.50 and B/t: 0.001 to 0.200.

11 Claims, 1 Drawing Sheet

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/38*** | (2006.01) |
| ***C23C 2/06*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/38* (2013.01); *C23C 2/06* (2013.01)

(56) References Cited

U.S. PATENT DOCUMENTS

| | | | | |
|---|---|---|---|---|
| 2015/0329946 | A1 | 11/2015 | Yasui et al. | |
| 2020/0232083 | A1 | 7/2020 | Morishita et al. | |
| 2020/0325554 | A1 * | 10/2020 | Takeda | C21D 6/001 |

FOREIGN PATENT DOCUMENTS

| | | | | |
|---|---|---|---|---|
| JP | 2014-58741 | A | 4/2014 | |
| KR | 10-2015-0088310 | A | 7/2015 | |
| WO | WO 2013/157222 | A1 | 10/2013 | |
| WO | WO 2014/054141 | A1 | 4/2014 | |
| WO | WO-2019116531 | A1 * | 6/2019 | B32B 15/015 |

* cited by examiner

GALVANIZED STEEL SHEET

FIELD

The present invention relates to a galvanized steel sheet. More specifically, the present invention relates to a thin and high strength galvanized steel sheet excellent in appearance properties.

BACKGROUND

In recent years, the steel sheets used in automobiles, household electric appliances, building materials, and other various fields have been made increasingly higher in strength. For example, in the automotive field, use of a high strength steel sheet has been increasing for the purpose of reducing the weight of car bodies so as to improve fuel efficiency. Typically, such a high strength steel sheet contains C, Si, Mn, and other elements for improving the strength of the steel.

Among members for automobile use, doors, hoods, roofs, and other members have much greater areas compared with pillars and other frame members, and therefore the high strength steel sheet used for these members generally becomes thinner from the viewpoint of lightening weight and is extremely large in width. Further, such members account for a large portion of the outside of an automobile, and therefore not only higher strength, but also excellent appearance is demanded.

On the other hand, in particular if used for members for automobile use, a high strength steel sheet is formed with a hot dip galvanized layer, hot dip galvannealed layer, or other plating layer on its surface from the viewpoint of improvement of the corrosion resistance, etc. In general, before forming such a plating layer, a steel sheet (typically cold rolled steel sheet) is often annealed at a certain level or more of temperature for removing stress from the steel sheet and/or improving workability.

In relation to this, a hot dip galvanized steel sheet or hot dip galvannealed steel sheet which contains C, Si, Mn, etc., as steel sheet constituents and is mainly suitably used for members for automobile use and methods for production of the same have been disclosed (for example, PTLs 1 to 4). Further, PTLs 1 to 4 teach that in order to produce the plated steel sheets described in PTLs 1 to 4, an annealing step is or may be performed before a plating step.

CITATIONS LIST

Patent Literature

[PTL 1] WO 2014/054141

[PTL 2] Japanese Unexamined Patent Publication No. 2014-058741

[PTL 3] WO 2013/157222

[PTL 4] Japanese Unexamined Patent Publication No. 2010-065269

SUMMARY

Technical Problem

Among the elements typically contained in a high strength steel sheet, Si and Mn, which are elements strong in affinity with oxygen, bond with the oxygen in the atmosphere in the annealing step and sometimes form a layer including oxides near the surface of the steel sheet. As the form of such a layer, a form in which oxides containing Si or Mn are formed as a film at the outside (surface) of the steel sheet (external oxidation) and a form in which oxides are formed at the inside (surface layer) of the steel sheet (internal oxidation) may be mentioned.

If forming a galvanized layer (for example, a hot dip galvanized layer or hot dip galvannealed layer) on the steel sheet surface on which an external oxide layer is formed, since the oxides are present as a film on the steel sheet surface, interdiffusion of the steel constituents (for example, Fe) and plating constituents (for example, Zn) is impeded. As a result, the reaction between the steel and plating layer is detrimentally affected and sometimes the plateability becomes insufficient (for example, nonplating parts increase). This being so, the appearance properties and corrosion prevention performance of the plated steel sheet are liable to deteriorate. Further, these oxides also affect the Fe—Zn reaction rate when alloying the plating layer. As a result, sometimes the plateability becomes insufficient (for example, uneven alloying occurs). In such a case as well, the appearance properties of the plated steel sheet are liable to deteriorate. Accordingly, from the viewpoint of obtaining plated steel sheet improved in the plateability and excellent in appearance properties, compared with a steel sheet on which an external oxide layer is formed, a steel sheet having an internal oxide layer in which oxides are present at the inside is preferable.

On the other hand, under annealing conditions where an internal oxide layer is formed, not only is an internal oxide layer formed, but also the phenomenon of decarburization arises near the steel sheet surface. "Decarburization" means that the carbon near the steel sheet surface bonds with the oxygen in the annealing atmosphere to become $CO_2$ and is discharged to the outside of the system. A region with insufficient carbon is referred to as a "decarburized layer". Since the carbon in the steel is an element contributing to the strength of the steel, if the decarburized layer becomes thick, the strength near the steel sheet surface falls. If the galvanized steel sheet is thick, the drop in strength at the steel sheet surface due to the presence of such a decarburized layer has a relatively small effect, and therefore does not particularly pose a problem. However, in the case of an extremely thin galvanized steel sheet, the effect of the drop in strength due to this decarburization cannot be ignored.

The present invention, in consideration of such a situation, has as its object the provision of a galvanized steel sheet comprised of a steel sheet with a thin thickness wherein sufficient strength and plateability can both be achieved.

Solution to Problem

The inventors discovered that by strictly controlling the ratio of the thickness of the internal oxide layer and the thickness of the decarburized layer at the steel sheet surface and the ratio of the thickness of the decarburized layer and thickness of the steel sheet in a galvanized steel sheet with a thickness of the steel sheet of 0.10 to 0.95 mm, it is possible to achieve both higher strength and a high plateability.

The present invention was made based on the above discovery and has as its gist the following:

(1) A galvanized steel sheet comprising a steel sheet having a chemical composition containing, by mass %, C: 0.05 to 0.30%, Si: 0.01 to 3.00%, Mn: 0.80 to 3.00%,
Al: 0.010 to 2.000%,
P: 0.100% or less,
S: 0.100% or less,
N: 0.0300% or less,
O: 0.010% or less,
B: 0 to 0.0100%,
Ti: 0 to 0.100%,
Nb: 0 to 0.100%,
V: 0 to 0.10%,
Cr: 0 to 1.00%,
Ni: 0 to 0.10%,
Cu: 0 to 0.10%,
Mo: 0 to 0.50%,
W: 0 to 0.50%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein the steel sheet has a thickness of 0.10 to 0.95 mm, and
a galvanized layer formed on at least one surface of the steel sheet, wherein
a tensile strength is 550 to 1500 MPa, and,
when defining a thickness of an internal oxide layer per surface of the steel sheet as "A" (μm), a thickness of a decarburized layer per surface of the steel sheet as "B" (μm), and a thickness of the steel sheet as "t" (μm),
A/B: 0.01 to 0.50 and
B/t: 0.001 to 0.200.

(2) The galvanized steel sheet according to (1), wherein a width of the steel sheet is 1500 to 3000 mm, and, when defining a standard deviation in a width direction at a thickness of the internal oxide layer as "a" (μm) and a standard deviation in a width direction at a thickness of the decarburized layer as "b" (μm),
A: 1.0 μm or more,
B: 10 μm or more,
a/A: 0.15 or less, and
b/B: 0.20 or less.

(3) The galvanized steel sheet according to (1) or (2), wherein, by mass %, Si+Mn: 5.00% or less and Si/Mn: 1.50 or less.

(4) The galvanized steel sheet according to any one of (1) to (3), wherein the steel sheet has a chemical composition containing, by mass %, one or more of
B: 0.0001 to 0.0100%,
Ti: 0.001 to 0.100%,
Nb: 0.001 to 0.100%,
Cr: 0.01 to 1.00%,
Mo: 0.01 to 0.50%, and
W: 0.01 to 0.50%.

(5) The galvanized steel sheet according to any one of (1) to (4), wherein the steel sheet has a chemical composition containing, by mass %, one or more of
V: 0.01 to 0.10%,
Ni: 0.01 to 0.10%,
Cu: 0.01 to 0.10%,
Ca: 0.001 to 0.100%,
Mg: 0.001 to 0.100%,
Zr: 0.001 to 0.100%,
Hf: 0.001 to 0.100%, and
REM: 0.001 to 0.100%.

(6) The galvanized steel sheet according to any one of (1) to (5), wherein the galvanized steel sheet is a hot dip galvannealed steel sheet, a chemical composition of the galvanized layer contains Fe: 5 to 15%, Al: 0.01 to 1% and a balance of Zn and impurities, and an amount of deposition per surface of the galvanized layer is 10 to 100 g/m$^2$.

Advantageous Effects of Invention

According to the present invention, it is possible to provide a galvanized steel sheet with a thickness of 0.10 to 0.95 mm where sufficient strength and plateability can both be achieved and to obtain a thin and high strength galvanized steel sheet excellent in appearance properties.

DESCRIPTION OF EMBODIMENTS

Figure 1:
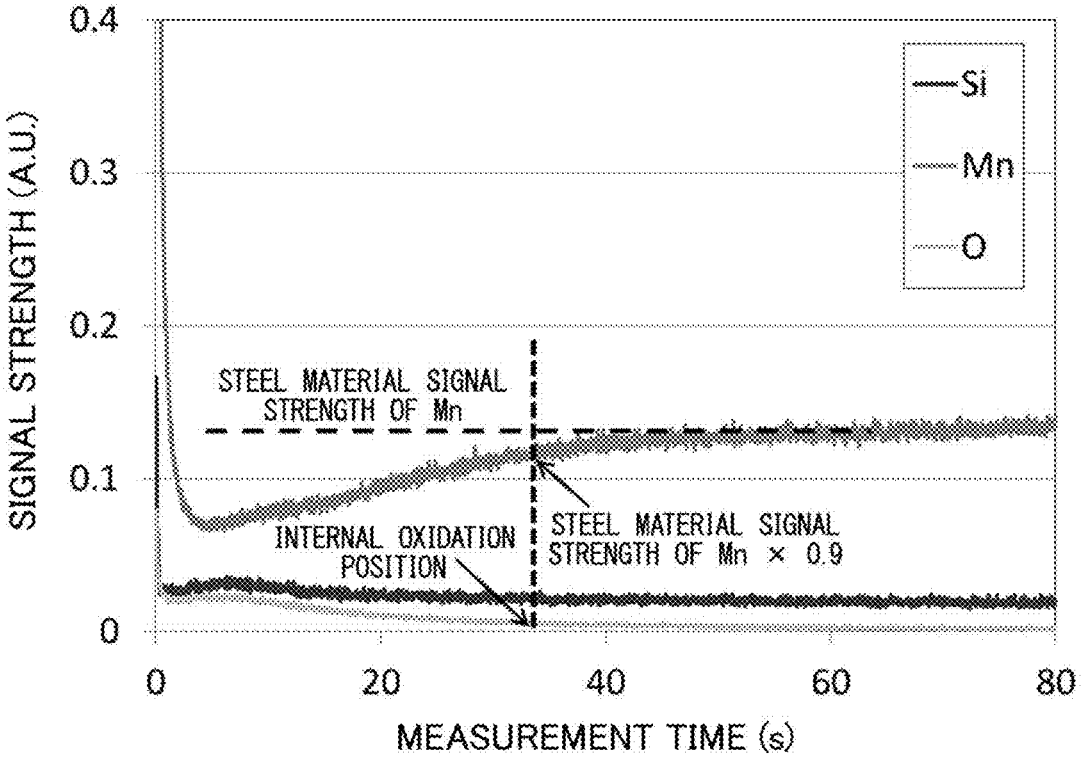
FIG. 1 is a view for explaining a method of measurement of a thickness of an internal oxide layer in the present invention.

For example, the galvanized steel sheet used for members for automobile use is in general produced by hot rolling and cold rolling a steel slab having a predetermined chemical composition including C, Si, Mn, etc., then annealing, then galvanizing and further if necessary alloying. In the annealing before the galvanization, to form the galvanized layer without nonplating parts and/or to reduce uneven alloying (uneven appearance after alloying treatment), it is preferable to suitably control the annealing conditions so as to form an internal oxide layer containing oxides of Si, Mn, Al, etc., at the surface layer (i.e., the inside) of the steel sheet. By forming these oxides inside of the steel sheet, in the galvanization, the steel constituents (for example, Fe) and the plating constituents (for example, Zn) interdiffuse well, a galvanized layer is formed well without nonplating parts, uneven alloying at the time of alloying can be reduced, and the plateability is improved. As a result, it is possible to obtain a galvanized steel sheet excellent in appearance properties. Accordingly, to secure sufficient plateability in the galvanized steel sheet, it is effective to control the annealing conditions and form an internal oxide layer at the surface layer of the steel sheet.

On the other hand, if performing annealing under annealing conditions where an internal oxide layer is formed, usually a decarburized layer is formed near the surface of the steel sheet. At the decarburized layer, there is an insufficient amount of the carbon which contributes greatly to the strength of a steel sheet, and therefore the strength falls near the surface of the steel sheet due to the presence of the decarburized layer. If using a galvanized steel sheet for a member with a relatively large thickness, the effect of the drop in strength due to the decarburized layer is also not large. However, in a galvanized steel sheet used for a member with a small thickness, for example, a door, hood, roof, or other member for automobile use, the effect of the drop in strength due to the decarburized layer is large and control of the thickness of the decarburized layer becomes extremely important. Accordingly, in a galvanized steel sheet having a thickness of 0.10 to 0.95 mm or less than 1 mm, it is preferable both to form an internal oxide layer from the viewpoint of obtaining good plateability (appearance properties) and to make the decarburized layer thinner from the viewpoint of securing strength.

Therefore, the inventors conducted various studies for achieving both higher strength and high plateability in a galvanized steel sheet having a thickness of 0.10 to 0.95 mm and as a result discovered that it is effective to add C, Mn, Si, and Al to steel in predetermined amounts or more and further strictly control the ratio of the thickness of the internal oxide layer and the thickness of the decarburized layer at the steel sheet surface and the ratio of the thickness of the decarburized layer and the thickness of the steel sheet. More specifically, the inventors discovered that when defining the thickness of the internal oxide layer per surface of the steel sheet as "A" (μm), the thickness of the decarburized layer per surface of the steel sheet as "B" (μm), and the thickness of the steel sheet as "t" (μm), making A/B a range of 0.01 to 0.50 and making B/t a range of 0.001 to 0.200 are important for securing plateability and strength.

<Galvanized Steel Sheet>

Below, the galvanized steel sheet according to the present invention (below, sometimes simply referred to as the "plated steel sheet") will be explained in detail.

The galvanized steel sheet according to the present invention has a steel sheet and a galvanized layer formed on at least one surface of the steel sheet. Accordingly, the galvanized layer may be formed on one surface of the steel sheet or may be formed on both surfaces. Further, in the present invention, it is only necessary that a galvanized layer be formed on the steel sheet. Another plating layer may also be provided between the steel sheet and the galvanized layer. The "galvanized layer", as explained later, means a plating layer including zinc. For example, it means a hot dip galvanized layer and hot dip galvannealed layer.

[Steel Sheet]

(Chemical Composition)

The chemical composition contained in the steel sheet in the present invention will be explained next. The "%" relating to the contents of the elements means "mass %" unless otherwise indicated. In the numerical ranges in the chemical composition, numerical ranges expressed using "to", unless otherwise indicated, will mean the ranges including the numerical values described before and after the "to" as lower limit values and upper limit values.

(C: 0.05 to 0.30%)

C (carbon) is an element important for securing the strength of the galvanized steel sheet. If the C content is insufficient, sufficient strength is liable to be unable to be secured. Therefore, the C content is 0.05% or more, preferably 0.07% or more, more preferably 0.08% or more, still more preferably 0.10% or more. On the other hand, if the C content is excessive, the strength becomes excessively high and the weldability is liable to fall. Therefore, the C content is 0.30% or less, preferably 0.25% or less, more preferably 0.20% or less.

(Si: 0.01 to 3.00%)

Si (silicon) is an element effective for improving the strength of a steel sheet. Further, Si is one of the elements bonding with oxygen to form internal oxides during the annealing. On the other hand, Si is an element affecting the plateability and alloying speed. If the Si content is insufficient, internal oxidation is liable to insufficiently occur. Therefore, Si content is 0.01% or more, preferably 0.03% or more or 0.05% or more, more preferably 0.10% or more or 0.30% or more. On the other hand, if the Si content is excessive, deterioration of the surface properties is liable to be caused and poor appearance to result. Further, an Si-based oxide film (external oxide layer) is liable to be formed at the steel sheet surface. Therefore, the Si content is 3.00% or less, preferably 2.50% or less, more preferably 2.00% or less.

(Mn: 0.80 to 3.00%)

Mn (manganese) is an element effective for obtaining hard structures and thereby improving the strength of the steel sheet. Further, Mn is one of the elements bonding with oxygen to form internal oxides during the annealing. If the Mn content is insufficient, sufficient strength is liable to be unable to secure. Therefore, the Mn content is 0.80% or more, preferably 1.00% or more, more preferably 1.20% or more. On the other hand, if excessively adding Mn, Mn segregation will result in an uneven metallic microstructure and the workability is liable to drop. Therefore, the Mn content is 3.00% or less, preferably 2.80% or less, more preferably 2.50% or less.

(Si+Mn: 5.00% or Less and Si/Mn: 1.50 or Less)

In the chemical composition of the steel sheet in the present invention, from the viewpoint of better suppressing formation of an external oxide layer and promoting the formation of an internal oxide layer, the sum of the Si content and Mn content (Si+Mn) is preferably 5.00% or less, more preferably 4.80% or less, still more preferably 4.50% or less. The lower limit of Si+Mn is not particularly prescribed, but for example Si+Mn may be 0.81% or more, 0.90% or more, 1.00% or more, or 1.20% or more. Further, from the viewpoint of better improving the appearance properties of the galvanized steel sheet, the ratio (Si/Mn) of the Si content to the Mn content is preferably 1.50 or less, more preferably 1.20 or less. Si and Mn contribute to improvement of the strength of steel, but if excessively included, sometimes worsen the appearance properties. Further, the effect on the appearance properties is more remarkable with Si than Mn. Therefore, from the viewpoint of the strength and the viewpoint of forming internal oxides, Si and Mn can be included in predetermined amounts or more and Si/Mn reduced so as to better maintain the appearance properties. The lower limit of Si/Mn is not particularly prescribed, but for example Si/Mn may be 0.01 or more, 0.03 or more, or 0.10 or more. As an element able to take the place of Si, there is Al, but if adding Al as an alternative to Si, there is no need to consider the Al content for the above sum and ratio.

(Al: 0.010 to 2.000%)

Al (aluminum) is an element acting as a deoxidizing element. If the Al content is less than 0.010%, sometimes it is not possible to sufficiently obtain the effect of deoxidation. Therefore, the Al content is 0.010% or more, preferably 0.100% or more, more preferably 0.200% or more. On the other hand, if excessively containing Al, a drop in the workability and deterioration of the surface properties are liable to be caused. Therefore, the Al content is 2.000% or less, preferably 1.500% or less, more preferably 1.000% or less.

(P: 0.100% or Less)

P (phosphorus) is an impurity generally contained in steel. If the P content is more than 0.100%, the weldability is liable to fall. Therefore, the P content is 0.100% or less, preferably 0.080% or less, more preferably 0.050% or less, still more preferably 0.020% or less. The lower limit of the P content is not particularly prescribed, but from the viewpoint of the production costs, the P content may be more than 0% or 0.0010% or more.

(S: 0.100% or Less)

S (sulfur) is an impurity generally contained in steel. If the S content is more than 0.100%, the weldability is liable to fall and furthermore the amount of precipitation of MnS is liable to increase and the bendability and other workability to fall. Therefore, the S content is 0.100% or less, preferably 0.080% or less, more preferably 0.050% or less, still more preferably 0.020% or less. The lower limit of the S content is not particularly prescribed, but from the viewpoint of the desulfurization costs, the S content may be more than 0% or 0.001% or more.

(N: 0.0300% or Less)

N (nitrogen) is an impurity generally contained in steel. If the N content is more than 0.0300%, the weldability is liable to fall. Therefore, the N content is 0.0300% or less, preferably 0.0200% or less, more preferably 0.0100% or less, still more preferably 0.0050% or less. The lower limit of the N content is not particularly prescribed, but from the viewpoint of the production costs, the N content may be more than 0% or 0.0010% or more.

(O: 0.010% or Less)

O (oxygen) is an impurity generally contained in steel. If the O content is more than 0.010%, deterioration of the ductility is liable to be invited. Therefore, the O content is 0.010% or less, preferably 0.008% or less, more preferably 0.006% or less, still more preferably 0.005% or less. The lower limit of the O content is not particularly prescribed, but from the viewpoint of the production costs, the O content may be more than 0% or 0.0010% or more.

The steel sheet in the present invention may contain the optional elements explained below in accordance with need in addition to the elements explained above.

(B: 0 to 0.0100%)

B (boron) is an element raising the hardenability to contribute to improvement of strength and further segregating at the grain boundaries to strengthen the grain boundaries and improve the toughness, and therefore may be contained according to need. Therefore, the B content is 0% or more, preferably 0.00010% or more, more preferably 0.0010% or more, still more preferably 0.0020% or more. On the other hand, from the viewpoint of securing sufficient toughness and weldability, the B content is 0.0100% or less, preferably 0.0090% or less, more preferably 0.0080% or less.

(Ti: 0 to 0.100%)

Ti (titanium) is an element precipitating as TiC during cooling of the steel and contributing to improvement of the strength, and therefore may be contained according to need. Therefore, the Ti content is 0% or more, preferably 0.001% or more, more preferably 0.010% or more, still more preferably 0.020% or more. On the other hand, if excessively contained, coarse TiN is liable to be formed and the toughness to be damaged, and therefore the Ti content is 0.100% or less, preferably 0.090% or less, more preferably 0.080% or less.

(Nb: 0 to 0.100%)

Nb (niobium) is an element having the effect of forming NbC in the steel and refining the crystal grains and contributing to improvement of the strength, and therefore may be contained according to need. Therefore, the Nb content is 0% or more, preferably 0.001% or more, more preferably 0.010% or more, still more preferably 0.020% or more. On the other hand, from the viewpoint of securing sufficient toughness and weldability, the Nb content is 0.100% or less, preferably 0.090% or less, more preferably 0.080% or less.

(V: 0 to 0.10%)

V (vanadium) is an element forming VC and contributing to improvement of strength, and therefore may be contained according to need. Therefore, the V content is 0% or more, preferably 0.01% or more, more preferably 0.02% or more, still more preferably 0.030% or more. On the other hand, from the viewpoint of securing sufficient toughness and weldability, the V content is 0.10% or less, preferably 0.09% or less, more preferably 0.08% or less.

(Cr: 0 to 1.00%)

Cr (chromium) is an element contributing to improvement of the strength and corrosion resistance of steel, and therefore may be contained according to need. Therefore, the Cr content is 0% or more, preferably 0.01% or more, more preferably 0.05% or more, still more preferably 0.10% or more. On the other hand, if excessively contained, Cr carbides are formed in a large amount and conversely the hardenability is liable to be damaged, and therefore the Cr content is 1.00% or less, preferably 0.90% or less, more preferably 0.80% or less, still more preferably 0.60% or less.

(Ni: 0 to 0.10%)

Ni (nickel) is an element contributing to improvement of the strength and corrosion resistance of steel, and therefore may be contained according to need. Therefore, the Ni content is 0% or more, preferably 0.010% or more, more preferably 0.02% or more. On the other hand, from the viewpoint of the production costs, etc., the Ni content is 0.10% or less, preferably 0.08% or less.

(Cu: 0 to 0.10%)

Cu (copper) is an element contributing to improvement of the strength and corrosion resistance of steel, and therefore may be contained according to need. Therefore, the Cu content is 0% or more, preferably 0.010% or more, more preferably 0.02% or more. On the other hand, from the viewpoint of suppressing a drop in toughness, cracking of the slab after casting, or a drop in weldability, the Cu content is 0.10% or less, preferably 0.08% or less.

(Mo: 0 to 0.50%)

Mo (molybdenum) is an element contributing to improvement of the strength and corrosion resistance of steel, and therefore may be contained according to need. Therefore, the Mo content is 0% or more, preferably 0.01% or more, more preferably 0.10% or more. On the other hand, from the viewpoint of securing sufficient toughness and weldability, the Mo content is 0.50% or less, preferably 0.40% or less, more preferably 0.30% or less.

(W: 0 to 0.50%)

W (tungsten) is effective for raising the strength of steel, and therefore may be contained according to need. Therefore, the W content is 0% or more, preferably 0.010% or more, more preferably 0.05% or more, still more preferably 0.10% or more. On the other hand, from the viewpoint of suppressing a drop in toughness or weldability, the W content is 0.50% or less, preferably 0.40% or less, more preferably 0.30% or less.

(Ca: 0 to 0.100%)

Ca (calcium) is an element contributing to inclusion control, in particular fine dispersion of inclusions, and having an action raising the toughness, and therefore may be contained according to need. Therefore, the Ca content is 0% or more, preferably 0.001% or more, more preferably 0.005% or more, still more preferably 0.010% or more, even more preferably 0.020% or more. On the other hand, if excessively contained, sometimes the surface properties noticeably deteriorate, therefore the Ca content is 0.100% or less, preferably 0.080% or less, more preferably 0.050% or less.

(Mg: 0 to 0.100%)

Mg (magnesium) is an element contributing to inclusion control, in particular fine dispersion of inclusions, and having an action raising the toughness, and therefore may be contained according to need. Therefore, the Mg content is 0% or more, preferably 0.001% or more, more preferably 0.003% or more, still more preferably 0.010% or more. On the other hand, if excessively contained, sometimes the surface properties noticeably deteriorate, therefore the Mg content is 0.100% or less, preferably 0.090% or less, more preferably 0.080% or less.

(Zr: 0 to 0.100%)

Zr (zirconium) is an element contributing to inclusion control, in particular fine dispersion of inclusions, and having an action raising the toughness, and therefore may be contained according to need. Therefore, the Zr content is 0% or more, preferably 0.001% or more, more preferably 0.005% or more, still more preferably 0.010% or more. On the other hand, if excessively contained, the surface properties noticeably deteriorate, so the Zr content is 0.100% or less, preferably 0.050% or less, more preferably 0.030% or less.

(Hf: 0 to 0.100%)

Hf (hafnium) is an element contributing to inclusion control, in particular fine dispersion of inclusions, and having an action raising the toughness, and therefore may be contained according to need. Therefore, the Hf content is 0% or more, preferably 0.001% or more, more preferably 0.005% or more, still more preferably 0.010% or more. On the other hand, if excessively contained, sometimes the surface properties noticeably deteriorate, therefore the Hf content is 0.100% or less, preferably 0.050% or less, more preferably 0.030% or less.

(REM: 0 to 0.100%)

A REM (rare earth metal) is an element contributing to inclusion control, in particular fine dispersion of inclusions, and having an action raising the toughness, and therefore may be contained according to need. Therefore, the REM content is 0% or more, preferably 0.0010% or more, more preferably 0.005% or more, still more preferably 0.010% or more. On the other hand, if excessively contained, the surface properties noticeably deteriorate, so the REM content is 0.100% or less, preferably 0.050% or less, more preferably 0.030% or less. REM is an abbreviation for a "rare earth metal" and means an element belonging to the lanthanoids. A REM is usually added as a mischmetal.

In the present invention, the steel sheet may contain, among the above optional elements, one or more of B: 0.0001 to 0.0100%, Ti: 0.001 to 0.100%, Nb: 0.001 to 0.100%, Cr: 0.01 to 1.00%, Mo: 0.01 to 0.50%, and W: 0.01 to 0.50%. Alternatively or additionally, the steel sheet may contain one or more of V: 0.01 to 0.10%, Ni: 0.01 to 0.10%, Cu: 0.01 to 0.10%, Ca: 0.001 to 0.100%, Mg: 0.001 to 0.100%, Zr: 0.001 to 0.100%, Hf: 0.001 to 0.100%, and REM: 0.001 to 0.100%.

In the steel sheet in the present invention, the balance besides the above chemical composition is comprised of Fe and impurities. Here, "impurities" means constituents which enter from raw materials such as ore and scrap due to various factors in the production process when industrially producing steel sheet and which are allowed to be contained to an extent not having a detrimental effect on the properties of the galvanized steel sheet according to the present invention.

The chemical composition of the steel sheet may be analyzed by any chemical analysis known to a person skilled in the art. For example, it may be performed by inductively coupled plasma mass spectrometry (ICP-MS). However, C and S may be measured using combustion-infrared absorption and N may be measured using inert gas fusion-thermal conductivity. These analyses may be performed on samples of the steel sheet obtained by the method based on JIS G0417: 1999.

(Thickness and Width of Steel Sheet) The present invention covers a galvanized steel sheet using a steel sheet having a thickness of 0.10 to 0.95 mm. More specifically, for example, it covers a galvanized steel sheet using a steel sheet having a thickness of 0.10 to 0.95 mm able to be suitably used for a door, hood, roof, or other member of an automobile. The thickness of the steel sheet, from the viewpoint of securing strength, is preferably 0.20 mm or more, more preferably 0.30 mm or more. In the sense of lightening the weight, a smaller thickness is preferable. Preferably it is 0.70 mm or less, more preferably 0.60 mm or less, still more preferably 0.50 mm or less. Further, since the galvanized steel sheet according to the present invention is suitably used for in particular doors, hoods, roofs, and other members for automobile use, the width of the galvanized steel sheet (i.e., steel sheet) is typically 1000 mm or more and in some cases is 1500 mm or more. The thickness of the steel sheet may be found using a micrometer, etc. When measuring the thickness of the steel sheet after removing the plating layer from the plated steel sheet, it is possible to remove the plating layer and measure the thickness by a micrometer, etc., or find it from observation of the cross-section. The width of the steel sheet may be directly measured by a ruler, tape measure, etc.

(Internal Oxide Layer)

The galvanized steel sheet according to the present invention has an internal oxide layer containing oxides at the surface layer of the steel sheet (inside of steel sheet). The oxides of the internal oxide layer include, in addition to oxygen, one or more of the above-mentioned elements included in the steel sheet. Typically, they have a chemical composition including Si, O, Fe, and Mn and further, in some cases, Al. Typically the oxides have $Mn_2SiO_4$, $SiO_2$, MnO, and other such compositions. In the galvanized steel sheet according to the present invention, the layer of oxides is not formed as the external oxide layer, i.e., on the surface of the steel sheet in a film like manner, but a layer in which the oxides are present is formed as the internal oxide layer, i.e., at the inside of the steel sheet. Therefore, if forming a plating layer, interdiffusion of the steel constituents (for example, Fe) and the plating constituents (for example, Zn) occurs well, a galvanized layer is formed well on the steel sheet, and a galvanized steel sheet excellent in appearance properties can be obtained without nonplating parts, etc., being formed. Further, if performing alloying, it is possible to suppress uneven alloying and possible to obtain a galvanized steel sheet excellent in appearance properties. In order to secure plateability, the internal oxide layer may be formed in a certain amount. Rather, if forming the internal oxide layer thickly, the decarburized layer, a factor lowering the strength, also becomes thicker, and therefore excessively forming the internal oxide layer is not preferable. For example, the thickness per surface of the internal oxide layer may be about 0.01 to 0.20 time the thickness of the steel sheet. The thickness A (μm) of the internal oxide layer per surface of the steel sheet in the present invention is not particularly limited, but, for example, may be 1.0 μm or more, 2.0 μm or more, 3.0 μm or more, or 5.0 μm or more. The upper limit of A is not particularly prescribed, but from the viewpoint of suppressing excessive formation of a decarburized layer, for example, it may be 50.0 μm or less, 40.0 μm or less, 30.0 μm or less, or 20.0 μm or less.

(Decarburized Layer)

The galvanized steel sheet according to the present invention has a decarburized layer near the surface of the steel sheet. The decarburized layer has a carbon concentration lower than the carbon concentration of the main part of the steel sheet (for example, the center part of sheet thickness). In the present invention, the "decarburized layer" means a region which is present at the steel sheet side from the interface of the steel sheet and the galvanized layer and which becomes lower in carbon concentration compared with the base material. In the galvanized steel sheet according to the present invention, as explained later, the thickness of the decarburized layer is controlled with respect to the thickness of the steel sheet and the thickness of the internal oxide layer, and therefore it is possible to suppress a drop in strength of the galvanized steel sheet due to the presence of the decarburized layer and possible to secure plateability while achieving higher strength. The thickness B (μm) of the decarburized layer in the present invention is preferably small from the viewpoint of securing higher strength. However, the decarburized layer is formed to some extent together with the internal oxide layer. Therefore, B is not particularly limited, but is substantially m or more. For example, it may be 15 μm or more, 20 μm or more, 25 μm or more, 30 μm or more, or 40 μm or more. From the viewpoint of securing a higher, in particular a higher and more uniform, strength, the upper limit of B is preferably 200 μm or less, more preferably 150 μm or less or 120 μm or less, still more preferably 100 μm or less or 90 μm or less.

(A/B: 0.01 to 0.50)

In the galvanized steel sheet according to the present invention, to obtain a high plateability, it is necessary to promote the formation of an internal oxide layer. On the other hand, to obtain a high strength, it is necessary to suppress the formation of a decarburized layer. Therefore, it is preferable to secure a thickness A (μm) per surface of the internal oxide layer to a certain extent while making the thickness B (μm) per surface of the decarburized layer smaller. Accordingly, in the present invention, the lower limit of A/B is 0.01. By A/B being 0.01 or more, it is possible to achieve both higher strength and high plateability. If A/B becomes less than 0.01, the internal oxide layer is not sufficiently formed and the plateability falls and/or the decarburized layer becomes thicker and the strength is liable to become insufficient. The lower limit of A/B is preferably 0.03 or 0.05, more preferably 0.10 or 0.15, still more preferably 0.20. On the other hand, usually, under conditions where internal oxidation occurs, the thickness B of the decarburized layer becomes greater than the thickness A of the internal oxide layer, and therefore the upper limit of A/B becomes substantially 0.50. The upper limit of A/B may be less than 0.50, and may be 0.45, 0.40, or 0.30. The decarburized layer is preferably thin from viewpoint of securing strength, but to secure plateability, is formed somewhat when forming the internal oxide layer, and therefore in the present invention, the thickness B per surface of the decarburized layer will not become 0. "A" means the thickness of the internal oxide layer per surface of the steel sheet.

(B/t: 0.001 to 0.200)

Furthermore, in the galvanized steel sheet according to the present invention, to suppress the formation of the decarburized layer and achieve higher strength, it is preferable to make the thickness B (μm) per surface of the decarburized layer smaller in a relationship with the thickness "t" (μm) of the steel sheet. In particular, the thickness of the steel sheet of the present invention is an extremely thin 0.10 to 0.95 mm (100 to 950 μm), and therefore such control becomes extremely important. Accordingly, in the present invention, the upper limit of B/t is 0.200. By B/t being 0.200 or less, the effect of the drop in strength due to the presence of the decarburized layer can be suppressed and a galvanized steel sheet having sufficient strength can be obtained. If B/t becomes more than 0.200, the decarburized layer is liable to become thicker in a relationship with the thickness of the steel sheet and the strength to become insufficient. The upper limit of B/t may be 0.190, 0.180, 0.160, 0.140, 0.120, or 0.100. On the other hand, in the present invention, to secure the plateability, it is necessary to form the internal oxide layer to a certain extent of thickness, and therefore the decarburized layer is also formed to a certain extent. Accordingly, the lower limit of B/t becomes substantially 0.001. The lower limit of B/t may also be 0.010, 0.020, 0.030, 0.040, or 0.050. "B" means the thickness of the decarburized layer per surface of the steel sheet. In other words, when B affects the steel sheet strength, both sides of the steel sheet are affected.

(Preferable Embodiment in Case of Sheet Width of 1500 to 3000 mm)

If using the galvanized steel sheet for doors, hoods, roofs, or other members for automobile use, these members have extremely large areas, so the galvanized steel sheet typically has a width of 1500 mm or more. According to a preferable embodiment according to the present invention, as explained above, by controlling the ratio of the thickness of the internal oxide layer and the thickness of the decarburized layer at the steel sheet surface and ratio of the thickness of the decarburized layer and the thickness of the steel sheet to within predetermined ranges and in addition strictly controlling the variations of the thicknesses of the internal oxide layer and the decarburized layer in the width direction of the steel sheet, it is possible to reliably achieve good properties in the steel sheet as a whole even in the galvanized steel sheet with such a large sheet width and therefore large area. More specifically, in a galvanized steel sheet having a thickness of 0.10 to 0.95 mm and a large width of 1500 to 3000 mm, if defining the thickness of the internal oxide layer per surface of the steel sheet as "A" (μm), the thickness of the decarburized layer per surface of the steel sheet as "B" (μm), the standard deviation in the width direction in the thickness of the internal oxide layer as "a" (μm), and the standard deviation in the width direction in the thickness of the decarburized layer as "b" (μm), it is possible to reliably achieve both higher strength and high plateability in the steel sheet as a whole by control so that A: 1.0 μm or more, B: m or more, a/A: 0.15 or less, and b/B: 0.20 or less. In particular, according to a preferable embodiment according to the present invention, due to the above-mentioned constitution, it is possible to maintain a high plateability and improve the appearance not only before shaping the steel sheet, but also after shaping it, i.e., even after imparting stress. Below, a preferable embodiment according to the present invention will be explained in more detail.

(Width of Steel Sheet)

The width of the steel sheet need only be 1500 to 3000 mm. For example, it may be 1600 mm or more, 1800 mm or more, or 2000 mm or more. As explained earlier, the width of the steel sheet may be directly measured by a ruler, tape measure, etc.

(A: 1.0 μm or More and a/A: 0.15 or Less)

In a preferable embodiment according to the present invention, if defining the thickness of the internal oxide layer per surface of the steel sheet as "A" (μm) and the standard deviation in the width direction of the thickness of the internal oxide layer as "a" (μm), A is 1.0 μm or more and a/A is 0.15 or less. By a/A being 0.15 or less, it is possible to suppress variation of the thickness of the internal oxide layer in the width direction of the steel sheet having a width of 1500 to 3000 mm, possible to sufficiently uniformly control the thickness of the internal oxide layer in the steel sheet as a whole, and as a result enable the galvanized steel sheet according to the present invention to have a high and uniform plateability as a whole. On the other hand, if the value of a/A is too large, the thickness of the internal oxide layer of the steel sheet as a whole is not sufficiently uniform, the plateability does not become uniform in the width direction, and the galvanized steel sheet is liable to no longer exhibit a high and uniform plateability as a whole. a/A is preferably 0.14 or less or 0.12 or less, more preferably 0.10 or less, still more preferably 0.08 or less. The lower limit of a/A is not particularly prescribed, but variation occurs in the thickness of the internal oxide layer somewhat due to production, therefore a/A may be more than 0 or 0.01 or more.

(B: 10 μm or More and b/B: 0.20 or Less)

In a preferable embodiment according to the present invention, if defining the thickness of the decarburized layer per surface of the steel sheet as "B" (μm) and the standard deviation in the width direction of thickness of the decarburized layer as "b" (μm), B is 10 μm or more and b/B is 0.20 or less. By b/B being 0.20 or less, it is possible to suppress variation in the thickness of the decarburized layer in the width direction of the steel sheet having a width of 1500 to 3000 mm. The uniformity of the decarburized layer in the width direction greatly affects the appearance when an external panel is given some stress. In other words, if local uneven strength occurs under conditions where the thickness of the steel sheet becomes thin, the strength of the steel sheet becomes high, and the thickness of the decarburized layer becomes relatively thick, stress imparted from the outside concentrates at thick portions of the decarburized layer, i.e., portions of low strength, and sometimes local roughness is caused at the steel sheet surface. In such a case, even if having a good appearance before shaping, after imparting stress, sometimes uneven appearance results in the L-direction (rolling direction). By making b/B smaller, it is possible to suppress local unevenness of the material quality and maintain high plateability and secure uniform appearance even after shaping. b/B is preferably 0.15 or less, more preferably 0.12 or less, still more preferably 0.10 or less. The lower limit of b/B is not particularly prescribed, but the variation occurs in the thickness of the internal oxide layer somewhat due to production, therefore b/B may be more than 0 or 0.01 or more.

(Measurement of Thickness A (μm) of Internal Oxide Layer and Calculation of Variation "a" (μm) of that Thickness)

The thickness A (μm) of the internal oxide layer is measured and the variation "a" (μm) of the thickness is calculated in the following way. The galvanized layer of the galvanized steel sheet to be measured is removed by being chemically dissolved in a solution of hydrochloric acid, etc., to which an inhibitor is added, then a glow discharge spectrometer (GDS) is used to analyze the composition in the thickness of the steel sheet and evaluate the thickness of the internal oxide layer. Specifically, the sputter depth after sputtering for a certain time from the steel sheet surface toward the thickness direction of the steel sheet is measured by a roughness meter, laser microscope, or other technique to calculate the sputter rate per unit time. Here, if Mn is internally oxidized, the profile of Mn concentration falls once from the Mn signal strength of the steel material, then gradually increases and reaches the Mn signal strength of the steel material. In the present invention, the position where an Mn signal strength of 0.9 time the Mn signal strength of the steel material is fined as the internal oxidation position and the sputter time when reaching the internal oxidation position is converted to thickness by the sputter rate. This is deemed the thickness of the internal oxide layer. In other words, in the present invention, the "internal oxide layer" means the region where the Mn concentration becomes 0.9 time or less the Mn concentration of the steel material by measurement by a glow discharge spectrometer (GDS). FIG. 1 shows one example of the GDS profile of Mn, etc. The above operation is performed at three locations or more and the thicknesses of the internal oxide layer found at the locations are averaged to obtain the thickness A (μm) per surface of the internal oxide layer at the present invention. In particular, in the case of steel sheet with a width of 1500 to 3000 mm, in the width direction of the steel sheet, the operation is performed at the three locations of one end part, the center part, and the other end part at the opposite side to the one end part, three locations at equal intervals between the one end part and the center part, and three locations at equal intervals between the center part and the other end part, for a total of nine locations, or a total of 18 locations at the front and back, and the thicknesses of the internal oxide layer found at the locations are averaged to obtain the thickness A (μm) per surface of the internal oxide layer in the present invention. Further, the standard deviation "a" (μm) in the width direction of the thickness of the internal oxide layer in the present invention is the standard deviation of the thickness of the internal oxide layer of the 18 locations found in the above way. The GDS used is a high frequency type. In this Description, the "one end part" and the "other end part" of the measurement positions are locations 100 mm inside from the actual one end and the other end of the steel sheet.

(Measurement of Thickness B (μm) and Calculation of Variation "b" (μm) of Thickness)

Figure 2:
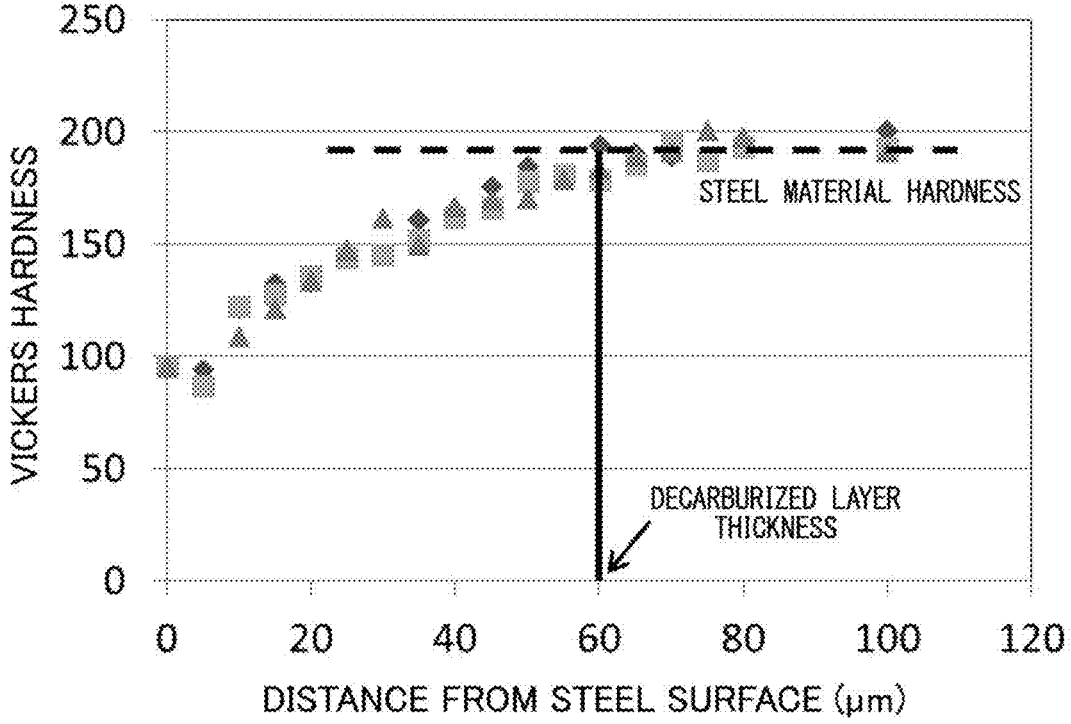
FIG. 2 is a view for explaining a method of measurement of a thickness of an decarburized layer in the present invention.

The thickness B (μm) of the decarburized layer is measured and the variation "b" (μm) of its thickness is calculated as follows: The galvanized layer of the galvanized steel sheet to be measured is removed by being chemically dissolved in a hydrochloric acid solution to which an inhibitor is added, then the hardness distribution in the cross-section of the steel sheet is measured to evaluate the thickness of the decarburized layer. Specifically, the steel sheet is made to corrode by 2% Nital to thereby examine the steel sheet microstructure, and the thickness of the decarburized layer is gauged. After that, the Vickers hardness of the cross-section is measured every 5 μm from the steel sheet surface (interface of steel sheet and plating layer) in the thickness direction. Judgment is usually possible if the measurement length is 100 to 150 μm or so. The distance up to the position where the hardness distribution reached the hardness of the steel sheet is defined as the thickness of the decarburized layer. In other words, in the present invention, the "thickness of the decarburized layer" means the distance up to where the hardness distribution from the steel sheet surface based on the Vickers hardness reaches the hardness of the steel sheet. The "steel sheet hardness" in the present embodiment is the average value of the hardnesses measured at any 10 locations at the center part in the thickness direction of the steel sheet cross-section. The actual measured examples of the thickness of the decarburized layer are shown in FIG. 2. The load of the Vickers hardness is not particularly set, but is measured every 5 μm, so is preferably not that large a load. FIG. 2 shows measurement by a load of 25 gf. The above operation is performed at three locations or more and the thicknesses of the decarburized layer found at the locations are averaged to obtain the thickness B (μm) per surface of the decarburized layer in the present invention. In particular, in the case of steel sheet with a width of 1500 to 3000 mm, the operation is performed at the three locations of one end part, the center part, and the other end part at the opposite side to the one end part in the width direction of the steel sheet, three locations at equal intervals between the one end part and the center part, and three locations at equal intervals between the center part and the other end part, for a total of nine locations, or a total of 18 locations at the front and back. The thicknesses of the decarburized layer found at the locations are averaged to obtain the thickness B (μm) per surface of the decarburized layer in the present invention. Further, the standard deviation "b" (μm) in the width direction in the thickness of the decarburized layer in the present invention is made the standard deviation of the thicknesses of the decarburized layer of the 18 locations found in the above way.

(Tensile Strength)

The galvanized steel sheet according to the present invention has a 550 to 1500 MPa tensile strength. By the tensile strength being 550 MPa or more, the strength can be sufficiently secured. For example, when used for a member for automobile use, lightening of weight by reduction of thickness can be achieved. The tensile strength is preferably 580 MPa or more or 600 MPa or more, more preferably 620 MPa or more, still more preferably 650 MPa or more, most preferably 700 MPa or more. On the other hand, if the tensile strength becomes higher, the workability is liable to fall, therefore the tensile strength is 1500 MPa or less and may be 1400 MPa or less or 1300 MPa or less. The tensile test is performed using a JIS No. 5 tensile test piece by the method prescribed in JIS-Z2241: 2011. The crosshead test speed of the tensile tester is 30 mm/min. In particular, in the case of steel sheet with a width of 1500 to 3000 mm, the tensile test is performed at the three locations of one end part, a center part, and other end part at the opposite side to the one end part in the width direction of the steel sheet, three locations at equal intervals between the one end part and the center part, and three locations at equal intervals between the center part and other end part, for a total of nine locations. The average value of the tensile strengths found at the locations is deemed the tensile strength according to the present invention.

[Galvanized Layer]

The galvanized layer in the present invention is formed on at least one surface of the steel sheet. The "galvanized layer" typically means a plating layer having a main constituent (i.e., more than 50%) comprised of Zn, but also encompasses layers where performing heat treatment after plating (for example, alloying), etc., causes the constituents in the steel to diffuse and as a result the Zn becoming 50% or less. The galvanized layer can be formed by various methods, but hot dip galvanization is preferable. Further, from the viewpoint of improving the weldability and/or coatability, alloying after hot dip galvanization is more preferable. Accordingly, the galvanized steel sheet according to the present invention is preferably a hot dip galvanized steel sheet. A hot dip galvannealed steel sheet is more preferable. In the present invention, the surface layer of the steel sheet is formed with an internal oxide layer rather than an external oxide layer, therefore the galvanized layer can for example be formed in a state suppressing the nonplated parts. In the case of alloying, it can be formed in a state suppressing uneven alloying.

(Chemical Composition of Galvanized Layer)

The preferable chemical composition contained in the galvanized layer in the present invention will be explained next, but if the galvanized layer is a plating layer containing Zn, that chemical composition is not particularly limited. Typically, the galvanized layer contains 50 mass % or more of Zn. Below, the "%" relating to the contents of the elements means "mass %" unless otherwise indicated. In the numerical ranges in the chemical composition, numerical ranges expressed using "to", unless otherwise indicated, will mean the ranges including the numerical values described before and after the "to" as lower limit values and upper limit values.

(Fe: 0 to 15%)

Fe can be contained in the plating layer by diffusing from the steel sheet if forming a plating layer containing Zn on a steel sheet, then heat treating the plated steel sheet. Therefore, the lower limit value of the Fe content may be 0%. To form the hot dip galvannealed layer, if alloying, the Fe in the steel diffuses in the plating layer, therefore in this case, the lower limit value of the Fe content is 1%, preferably 3%, more preferably 5%. On the other hand, the upper limit value of the Fe content is 15%. 12% is preferable, and 10% is more preferable. Accordingly, for example, if the galvanized layer is a hot dip galvannealed layer, the Fe content in the plating layer may be 5 to 15%.

(Al: 0 to 30%)

Al is an element included together with or alloyed with Zn and improving the corrosion resistance of the plating layer, and therefore may be contained according to need. Therefore, for example, if forming a plating layer by electrogalvanization, the Al content may be 0%. To form a plating layer containing Zn and Al, preferably the Al content is 0.01% or more. For example, it may be 0.1% or more or 0.5% or more. On the other hand, if more than 30%, the effect of improving the corrosion resistance becomes saturated, therefore the Al content is 30% or less. For example, it may be 20% or less, 10% or less, 5% or less, or 1% or less. Even if the plating bath does not contain Al, if performing alloying for forming a hot dip galvannealed layer, the Al in the steel diffuses in the plating layer. Accordingly, in this case, for example, the Al content may be 0.01 to 1%.

The basic chemical composition of the galvanized layer is as explained above. Furthermore, the galvanized layer, in particular the hot dip galvannealed layer, may optionally contain the above-mentioned elements included in the steel or other elements. These optional elements are not particularly limited, but from the viewpoint of sufficient exhibition of the actions and functions of the basic constituents forming the plating layer, a total content of 5% or less is preferable and 2% or less is more preferable.

In the galvanized layer in the present invention, the balance other than the above chemical composition is comprised of Zn and impurities. Here, the "impurities" in the galvanized layer means constituents which enter from raw materials due to various factors in the production process when industrially producing the plating layer and which are not constituents intentionally added to the plating layer. In the plating layer, as impurities, elements other than the basic constituents and optionally added constituents explained above may be contained in trace amounts to extents not obstructing the effect of the present invention.

(Amount of Deposition Per Surface)

The amount of deposition of the galvanized layer in the present invention is not particularly limited, but for example it may be 10 to 100 g/m$^2$. The amount of deposition of the plating per surface greatly affects the corrosion resistance. From the viewpoint of the corrosion resistance, the lower limit value of the amount of deposition is preferably 15 g/m$^2$, more preferably 20 g/m$^2$, still more preferably 30 g/m$^2$. On the other hand, from the viewpoint of the shapeability, weldability, and economy, the upper limit value of the amount of deposition per surface is preferably 90 g/m$^2$ more preferably 70 g/m$^2$, still more preferably 60 g/m$^2$.

The chemical composition and amount of deposition of the galvanized layer can be found by inductively coupled plasma (ICP) spectrometry. Specifically, the chemical composition and amount of deposition of the galvanized layer can be found by dissolving only the plating layer from the galvanized steel sheet having a galvanized layer and analyzing the obtained solution by ICP. The amount of deposition of plating in the present invention is the amount per surface, therefore if both surfaces of the steel sheet are formed with the galvanized layer, the amounts of deposition of plating at the two surfaces are calculated as being the same.

<Method of Production of Galvanized Steel Sheet>

Below, a preferable method of production of the galvanized steel sheet according to the present invention will be explained. The following explanation is intended to illustrate a characterizing method for producing the galvanized steel sheet according to the present invention and is not intended to limit the galvanized steel sheet to ones produced by a method of production such as explained below.

[Preparation of Steel Sheet]

The steel sheet in the present invention can be obtained by a casting step for casting molten steel adjusted in chemical composition to form a steel slab, a hot rolling step for hot rolling the steel slab to obtain hot rolled steel sheet, a pickling step for removing the oxides (scale) and preferably an internal oxide layer formed in the hot rolling step, a cold rolling step for cold rolling to obtain cold rolled steel sheet, a grinding step for grinding the cold rolled steel sheet, and an annealing step for annealing the cold rolled steel sheet.

(Casting Step)

The conditions of the casting step are not particularly limited. For example, after smelting by a blast furnace, electric furnace, etc., various secondary refining operations may be performed, then the steel may be cast by the usual continuous casting, casting by the ingot method, thin slab casting, or other method. For the material, scrap can be used, but the amount of scrap used is adjusted so that the contents of the elements of the obtained steel sheet satisfy the above ranges.

(Hot Rolling Step)

The steel slab cast in the above way can be hot rolled to obtain hot rolled steel sheet. The hot rolling step is performed by hot rolling the cast steel slab directly or by cooling it once, then reheating it. When performing the reheating, the heating temperature of the steel slab may be for example 1100° C. to 1250° C. In the hot rolling step, usually rough rolling and finish rolling are performed. The temperatures and rolling reductions of the different rolling operations may be suitably determined in accordance with the desired metallic microstructure and sheet thickness. For example, the finish rolling temperature may be 800 to 1050° C. and the rolling reduction of the finish rolling may be 50 to 80%. In the present invention, to make the thickness of the steel sheet smaller to finally 0.10 to 0.95 mm, the load in the cold rolling step would be large. Therefore, it is preferable to set the rolling reduction of the hot rolling on the high side to make the sheet thickness as small as possible at the time of hot rolling. Specifically, the sheet thickness after hot rolling is preferably made 2.5 mm or less. However, the thicknesses of the internal oxide layer and the decarburized layer formed near the surface of the steel sheet at the hot rolling are substantially constant, therefore if making the thickness after hot rolling smaller, the effects of the internal oxidation and decarburization at the hot rolling become relatively great. On the other hand, for example, if the internal oxide layer and decarburized layer formed at the hot rolling step are not sufficiently removed even by the later pickling step and grinding step and end up remaining in relatively large amounts, the internal oxide layer and decarburized layer will not be formed well in the annealing step or will end up being unevenly formed, so this is not desirable. Therefore, to suppress the formation of the internal oxide layer and decarburized layer in the hot rolling step and reduce the effect of internal oxidation and decarburization in the hot rolling, the coiling temperature is preferably 600° C. or less, more preferably 550° C. or less. In particular, when producing broad width steel sheet of a sheet width of 1500 to 3000 mm, in addition to this, as explained in detail below, it is preferable to use a hot rolling lubrication oil excellent in lubrication ability and to store the hot rolled coil after hot rolling and coiling in a state with the inside diameter hole of the hot rolled coil horizontal ("hole horizontal") to thereby uniformly form the internal oxide layer in the hot rolling step.

(Hot Rolling Lubrication Oil)

If the hot rolling lubrication conditions are not suitable, sometimes the distribution of stress at the surface of the steel sheet becomes uneven at the time of hot rolling. In such a case, the unevenness of internal oxidation in the width direction at the time of hot rolling becomes greater. This is disadvantageous as well for formation of a uniform internal oxide layer and decarburized layer in the later annealing step. Therefore, as the hot rolling lubrication oil for the hot rolling rolls, it is preferable to use hot rolling lubrication oil excellent in lubrication ability. For example, it is preferable to use a lubrication oil containing Ca sulfonate. By using such a hot rolling lubrication oil, it is possible to make the distribution of stress at the surface of the steel sheet at the time of hot rolling uniform. Therefore, it becomes possible to remarkably reduce the unevenness of internal oxidation in the width direction at the time of hot rolling.

(Storage of Hot Rolled Coil with "Hole Horizontal")

The hot rolled coil after hot rolling and coiling is temporarily stored until being supplied to the later pickling step and cold rolling step. In general, it is stored in a state with the inside diameter hole of the hot rolled coil vertical ("hole vertical") or in a state with the inside diameter hole of the hot rolled coil horizontal ("hole horizontal"). However, if storing the hot rolled coil with the hole vertical, the variation in temperature in the sheet width direction becomes greater and sometimes unevenness of internal oxidation occurs in the sheet width direction. In such a case, this becomes disadvantageous for formation of a uniform internal oxide layer and decarburized layer in the later annealing step. Therefore, to suppress or reduce such unevenness of internal oxidation, the hot rolled coil is preferably stored with the hole horizontal.

(Pickling Step)

The pickling step is performed so as to remove the surface scale formed on the surface of the hot rolled steel sheet in the hot rolling step. In the pickling step, usually a hydrochloric acid-based solution is used. In the present invention as well, similar conditions can be applied. Further, pickling is preferably performed by removing up to the internal oxide layer formed at the time of the hot rolling step.

(Cold Rolling Step)

The hot rolled steel sheet can be cold rolled to obtain cold rolled steel sheet. The rolling reduction of the cold rolling may be suitably determined in accordance with the desired metallic microstructure and sheet thickness. For example, it may be 30 to 90%. In the present invention, it is sufficient to suitably adjust the rolling reduction of the hot rolling step and the rolling reduction of the cold rolling step to obtain the final desired sheet thickness, but the thickness of the steel sheet in the present invention becomes a thin one of less than 1 mm, therefore to prevent breakage at the cold rolling step, for example, the rolling reduction of the hot rolling may be made larger than the rolling reduction of the cold rolling.

(Grinding Step)

To remove foreign matter remaining at the steel sheet surface and further to remove the scale and internal oxide layer formed at the surface and surface layer of the steel sheet at the time of hot rolling and also to make the surface properties uniform and promote the formation of an internal oxide layer at the next annealing step, a grinding step is preferably performed. More specifically, by performing a grinding step and sufficiently removing the internal oxide layer formed at the time of hot rolling while further imparting stress to the surface of the steel sheet, diffusion of oxygen from the steel sheet surface to the inside in the annealing atmosphere is promoted. Further, the reaction with the oxygen is activated, therefore formation of the internal oxide layer at the annealing step can be promoted. The grinding step is not particularly limited, but for example it can be performed by using heavy duty grinding brushes to grind down the surface of the steel sheet. The number, speed, grade, etc., of the heavy duty grinding brushes can be suitably selected to achieve the desired surface roughness and amount of grinding. In particular, if producing steel sheet with a width of 1500 to 3000 mm, by performing the grinding step by a plurality of heavy duty grinding brushes, it is possible to make the surface roughness uniform over the entire steel sheet in the width direction and impart uniform stress. Therefore, even with broad width steel sheet, the reaction with the oxygen in the annealing atmosphere is activated at all sorts of positions of the steel sheet and it is possible to control the variation of the thicknesses of the internal oxide layer and the decarburized layer of the steel sheet to be uniform. In particular, if producing steel sheet with a width of 1500 to 3000 mm, it is preferable that the number of pairs of heavy duty grinding brushes arranged above and below the steel sheet be three (three pairs) or more. The reason is that using a relatively large number of heavy duty grinding brushes and grinding a bit at a time is advantageous for making the surface roughness uniform over the entire steel sheet in the width direction and imparting uniform stress. The amount of grinding is preferably 2 $g/m^2$ or more per surface in total for all of the heavy duty grinding brushes. The grinding step can also be performed before the later explained annealing and plating lines.

(Annealing Step)

Next, the obtained cold rolled steel sheet is annealed. The annealing is preferably performed at a 750° C. or more temperature, more preferably is performed at a 780° C. or more temperature. The upper limit of the annealing temperature may be 920° C. or less from the viewpoint of suppressing the formation of an external oxide layer. The rate of temperature rise up to the annealing temperature is not particularly limited. For example, it may be 1 to 10° C./s. Further, from the viewpoint of sufficiently forming an internal oxide layer and suppress the formation of an external oxide layer, the holding time at the annealing temperature may be 5 to 300 seconds or so, preferably 50 to 100 seconds. If the annealing time is too long, a decarburized layer is excessively formed compared with the internal oxide layer, the B/t value becomes higher, and sometimes sufficient strength cannot be obtained. The atmosphere at the annealing step is an important factor in controlling the internal oxide layer and the decarburized layer. It is also possible to make the oxygen potential high at the start of the annealing and then reduce the oxygen potential or possible to raise the oxygen potential in the annealing as a whole. The oxygen potential can be expressed by the common logarithm log ($P_{H_2O}/P_{H_2}$) of the water vapor partial pressure $P_{H_2O}$ inside the annealing furnace divided by the hydrogen partial pressure $P_{H_2}$. To obtain the internal oxide layer and decarburized layer in the present invention, for example, it is possible to control the value found by the above formula to −3.0 to −1.0. As techniques for raising the oxygen potential, it is possible to use a combustion atmosphere, add a trace amount of oxygen, make the dew point rise, or employ a method combining these. If controlling the dew point, the dew point may be −20° C. or more, preferably −10° C. or more. If the dew point is too low, an external oxide layer is liable to be formed on the surface of the steel sheet. The upper limit of the dew point is not particularly set, but ingenuity is required for suppressing condensation so as to make it higher than ordinary temperature. The atmosphere at the time of annealing is preferably a reducing atmosphere, more preferably a reducing atmosphere containing nitrogen and hydrogen, for example, a reducing atmosphere of hydrogen 5% or less (for example, hydrogen 5% and nitrogen 95%). The annealing step can be performed continuing after formation of the galvanized layer explained later.

(Control of Thickness of Internal Oxide Layer and Thickness of Decarburized Layer and Variations of Same)

Formation of the internal oxide layer and decarburized layer, as explained above, mainly depend on the conditions in the hot rolling step, grinding step, and annealing step. However, in addition to this, the thickness of the internal oxide layer also depends on the amount of Si in the steel. Further, the thickness of the decarburized layer also depends on the amount of Si, amount of Mn, and amount of C in the steel. If making the amount of Si in steel increase, the thickness of the internal oxide layer and the thickness of the decarburized layer both become greater, while if making the amount of Mn in the steel increase, the thickness of the decarburized layer becomes smaller. Similarly, even if making the amount of C in the steel increase, the thickness of the decarburized layer becomes smaller. For this reason, to make A/B larger, it is effective to make the amount of C and amount of Mn increase. Further, as explained above, if making the sheet thickness after hot rolling a thin one of down to 2.5 mm or less, the effects of internal oxidation and decarburization in the hot rolling become relatively great. For this reason, in the hot rolling step, it becomes important to coil the steel sheet at a relatively low temperature to suppress internal oxidation and decarburization at the time of hot rolling and reduce the effects of the same. In addition to this, before the annealing step, it becomes important to sufficiently remove the internal oxide layer formed at the time of hot rolling by the pickling step and grinding step. Further, not only are the internal oxide layer, etc., formed at the grinding step and the time of hot rolling removed, but also stress is imparted to the steel sheet. By imparting stress to the steel sheet, formation of the internal oxide layer at the later annealing step is promoted, therefore the grinding step is an extremely important step. In addition, in particular, if producing broad width steel sheet of 1500 mm or more, from the viewpoint of controlling the variations a/As and b/B of the thickness of the internal oxide layer and the thickness of the decarburized layer in the width direction, it becomes necessary to also suitably select the hot rolling lubrication oil, the method of storage of the hot rolled coil, and the conditions of the grinding step. Therefore, to make the values of A, B, A/B, B/t, a/A, and/or b/B suitable ones, it is not sufficient to just control the formation of the internal oxide layer and decarburized layer in the annealing step. It becomes necessary to suitably control the amount of Si, amount of Mn, and amount of C in the steel and also the conditions of the hot rolling step and grinding step. The mutual effects of these conditions are complicated, so while not possible to state this outright, by fixing the conditions to a certain extent, it is possible to suitably control A, B, A/B, B/t, a/A, and b/B. Whatever the case, by just combining the composition of the steel sheet, hot rolling conditions, grinding conditions, and annealing conditions, it is not possible to satisfy the features of the internal oxide layer and decarburized layer according to the present invention. It is important to suitably combine the composition of the steel sheet, hot rolling conditions, grinding conditions, and annealing conditions so that these features are controlled to the desired ranges.

[Formation of Galvanized Layer]

The galvanized layer can be formed by electrogalvanization or by hot dip galvanization, preferably is formed by hot dip galvanization. In the case of hot dip galvanization, the conditions of the plating may be suitably set considering the chemical composition, thickness, amount of deposition, etc., of the desired plating layer. For example, the cooling after annealing may be stopped at 430 to 500° C. and the cold rolled steel sheet may be dipped in a hot dip galvanization bath for 1 to 5 seconds. The amount of deposition of the plating may be, for example, 10 to 100 g/m$^2$.

To improve the weldability and/or coatability after forming the galvanized layer, alloying is preferably performed. The alloying conditions may be those within the usual range. For example, the alloying may be performed by a 450 to 600° C. temperature.

EXAMPLES

Below, examples will be used to explain the present invention in more detail, but the present invention is not limited to these examples in any way.

Example A: Production of Galvanized Steel Sheet

In the present example, a galvanized steel sheet comprised of steel sheet of a thickness of 0.10 to 0.95 mm (100 to 950 μm) and a width of 1000 mm which was galvanized was produced. First, molten steel adjusted in chemical composition was cast to form a steel slab, the steel slab was cooled once, then reheated, the steel slab was hot rolled by a rolling reduction of 50% or more, and the obtained hot rolled steel sheet was coiled up. In all of the examples, the heating temperature of the steel slab at the time of reheating was 1200° C. and the finish rolling temperature was 950° C. The thickness after hot rolling and the coiling temperature were as described in Table 1. After that, hydrochloric acid was used to pickle the sheet. The surface sale was removed down to 0.2 μm or less. After pickling, the sheet was cold rolled by the cold rolling reduction described in Table 1. A sample was taken by the method based on JIS G0417: 1999 from the cold rolled steel sheet and the chemical composition of the steel sheet was analyzed. Further, any five locations of the cold rolled steel sheet were measured for the thickness of the steel sheet by a micrometer. The thicknesses were averaged to calculate the sheet thickness "t". The chemical compositions and sheet thicknesses of the of the steel sheets of the examples are shown in Tables 1 and 2.

Next, each cold rolled steel sheet was ground at its surface using heavy duty grinding brushes, then was annealed and hot dip galvanized by a continuous plating line and, with the exception of No. 26, was alloyed. In Table 1, samples which were alloyed after hot dip galvanization were indicated as "alloyed" while samples which were not alloyed after hot dip galvanization were indicated as "hot dip galvanized". The temperatures in the annealing, dew points, and holding times were as described in Table 1. The rates of temperature rise up to the annealing temperature were 10° C./s. Further, the annealing atmospheres were hydrogen 5% and nitrogen 95% reducing atmospheres controlled in dew points to oxygen potentials found by formula: $\log(P_{H2O}/P_{H2})$ of −3.0 to −1.0 in Nos. 1 to 19, 21, 22, and 24 to 27. No. 20 and No. 23 were controlled in dew points and annealed by low oxygen potentials. The hot dip galvanization was performed by stopping the cooling after annealing at 480° C., dipping the cold rolled steel sheet in a hot dip galvanization bath for 3 seconds, then adjusting the amount of plating deposition to about 50 g/m$^2$ per surface. In Example Nos. 101 to 125, 127, and 128, the sheets were alloyed at 550° C. after hot dip galvanization. In all of the examples, the plating layer contained Fe: 5 to 15% and Al: 0.01 to 1%.

(Measurement of Thickness A of Internal Oxide Layer)

The plating layer of each example was removed by chemically dissolving it in a hydrochloric acid solution to which an inhibitor was added, then a high frequency type GDS was used to analyze the composition in the thickness direction of the steel sheet to evaluate the thickness of the internal oxide layer. Specifically, the sputter depth after sputtering for a certain time from the steel sheet surface in the direction of the thickness of the steel sheet was measured by a laser microscope and the sputter rate per time was calculated. The position where an Mn signal strength of 0.9 time the Mn signal strength of the steel material is reached was identified and the sputter time for reaching that position was converted to depth by the sputter rate. This was deemed the thickness of the internal oxide layer. The above operation was performed at three locations and the thicknesses found at the locations were averaged to obtain the thickness A (μm) of the internal oxide layer (per surface).

(Measurement of Thickness B of Decarburized Layer)

The plating layer of each example was removed by chemically dissolving it in a hydrochloric acid solution to which an inhibitor was added, then the hardness distribution in the cross-section of the teel sheet was measured to thereby evaluate the thickness of the decarburized layer. Specifically, the steel sheet was made to corrode by 2% Nital to thereby examine the steel sheet microstructure, the decarburized layer was gauged, then the Vickers hardness of the cross-section was measured every 5 μm from the steel sheet surface (interface of steel sheet and plating layer) in the thickness direction. The measurement length was 100 μm. The position where the hardness distribution reached the hardness of the steel sheet was identified and that position was deemed the thickness of the decarburized layer. The measurement was performed at three locations and the three data were used to judge the thickness of the decarburized layer to obtain the thickness B (μm) of the decarburized layer (per surface). The load at the time of measurement of the Vickers hardness was 25 gf.

(Evaluation of Tensile Strength)

A tensile test was performed using a JIS No. 5 tensile test piece by the method prescribed in JIS-Z2241: 2011. The crosshead test speed of the tensile test was 30 mm/min. The obtained results are shown in Table 2.

(Evaluation of Plateability)

The plateability was evaluated by evaluating the appearance of the galvanized steel sheet of each example. Specifically, each example of a hot dip galvannealed steel sheet ("alloyed" in Table 1) was visually examined for appearance after alloying. An example where no uneven alloying was visually observed at all was evaluated as "very good", an example where it was substantially not visually observed was evaluated as "good", and an example where it was visually observed or nonplating was visually observed was indicated as "poor". Each example of a hot dip galvanized steel sheet ("hot dip galvanized" of Table 1) was visually observed after plating. One where nonplating was not visually observed was evaluated as "very good" and one where it was visually observed was indicated as "poor". The obtained results are shown in Table 2.

In the examples, the case where the tensile strength is 550 to 1500 MPa and the plateability is evaluated as "very good" or "good" is evaluated as a galvanized steel sheet having sufficient strength and plateability.

TABLE 1

| Ex. | Chemical composition of steel sheet [mass %]: balance Fe and impurities | | | | | | | | | | |
|---|---|---|---|---|---|---|---|---|---|---|---|
| no. | C | Si | Mn | P | S | Al | N | O | Others | Si + Mn | Si/Mn |
| 101 | 0.08 | 0.33 | 1.50 | 0.011 | 0.002 | 0.024 | 0.0032 | 0.004 | — | 1.83 | 0.22 |
| 102 | 0.12 | 0.35 | 1.51 | 0.010 | 0.003 | 0.031 | 0.0033 | 0.005 | Ti: 0.030 | 1.86 | 0.23 |
| 103 | 0.19 | 0.35 | 1.48 | 0.090 | 0.002 | 0.025 | 0.0028 | 0.003 | Nb: 0.020, B: 0.0021 | 1.83 | 0.24 |
| 104 | 0.37 | 0.36 | 1.45 | 0.010 | 0.001 | 0.029 | 0.0035 | 0.003 | — | 1.81 | 0.25 |
| 105 | 0.11 | 0.34 | 1.47 | 0.011 | 0.001 | 0.030 | 0.0033 | 0.003 | — | 1.81 | 0.23 |
| 106 | 0.08 | 0.89 | 1.55 | 0.013 | 0.001 | 0.033 | 0.0030 | 0.004 | Cr: 0.31, Mo: 0.10 | 2.44 | 0.57 |
| 107 | 0.07 | 1.55 | 1.53 | 0.012 | 0.002 | 0.031 | 0.0027 | 0.004 | Cu: 0.03, Ni: 0.02 | 3.08 | 1.01 |
| 108 | 0.18 | 2.21 | 2.70 | 0.001 | 0.001 | 0.030 | 0.0035 | 0.003 | Mg: 0.010 | 4.91 | 0.82 |
| 109 | 0.03 | 0.31 | 0.95 | 0.002 | 0.003 | 0.021 | 0.0024 | 0.002 | — | 1.26 | 0.33 |
| 110 | 0.07 | 3.15 | 2.55 | 0.015 | 0.002 | 0.038 | 0.0036 | 0.004 | — | 5.70 | 1.24 |
| 111 | 0.07 | 2.51 | 1.49 | 0.001 | 0.002 | 0.027 | 0.0027 | 0.003 | — | 4.00 | 1.68 |
| 112 | 0.10 | 0.03 | 1.71 | 0.013 | 0.004 | 0.350 | 0.0031 | 0.004 | V: 0.02 | 1.74 | 0.02 |
| 113 | 0.05 | 0.30 | 0.65 | 0.008 | 0.003 | 0.024 | 0.0026 | 0.003 | — | 0.95 | 0.46 |
| 114 | 0.10 | 0.02 | 1.33 | 0.014 | 0.005 | 0.022 | 0.0028 | 0.003 | W: 0.02 | 1.35 | 0.02 |
| 115 | 0.11 | 0.35 | 1.45 | 0.010 | 0.003 | 0.200 | 0.0030 | 0.003 | Ca: 0.010 | 1.80 | 0.24 |
| 116 | 0.11 | 0.35 | 1.45 | 0.010 | 0.003 | 0.200 | 0.0030 | 0.003 | Zr: 0.020 | 1.80 | 0.24 |
| 117 | 0.11 | 0.35 | 1.45 | 0.010 | 0.003 | 0.200 | 0.0030 | 0.003 | Hf: 0.010 | 1.80 | 0.24 |
| 118 | 0.11 | 0.35 | 1.45 | 0.010 | 0.003 | 0.200 | 0.0030 | 0.003 | REM: 0.010 | 1.80 | 0.24 |
| 119 | 0.09 | 0.02 | 1.30 | 0.008 | 0.003 | 2.200 | 0.0028 | 0.004 | — | 1.32 | 0.02 |
| 120 | 0.08 | 0.89 | 1.55 | 0.013 | 0.001 | 0.033 | 0.0030 | 0.004 | Cr: 0.31, Mo: 0.10 | 2.44 | 0.57 |
| 121 | 0.08 | 0.89 | 1.55 | 0.013 | 0.001 | 0.033 | 0.0030 | 0.004 | Cr: 0.31, Mo: 0.10 | 2.44 | 0.57 |
| 122 | 0.08 | 0.89 | 1.55 | 0.013 | 0.001 | 0.033 | 0.0030 | 0.004 | Cr: 0.31, Mo: 0.10 | 2.44 | 0.57 |
| 123 | 0.11 | 0.35 | 1.51 | 0.011 | 0.003 | 0.500 | 0.0029 | 0.003 | — | 1.86 | 0.23 |
| 124 | 0.11 | 0.35 | 1.51 | 0.011 | 0.003 | 0.500 | 0.0029 | 0.003 | — | 1.86 | 0.23 |
| 125 | 0.11 | 0.15 | 1.51 | 0.011 | 0.003 | 1.500 | 0.0029 | 0.003 | — | 1.66 | 0.10 |
| 126 | 0.08 | 0.89 | 1.55 | 0.013 | 0.001 | 0.033 | 0.0030 | 0.004 | Cr: 0.31, Mo: 0.10 | 2.44 | 0.57 |
| 127 | 0.08 | 0.33 | 1.50 | 0.011 | 0.002 | 0.024 | 0.0032 | 0.004 | — | 1.83 | 0.22 |
| 128 | 0.21 | 0.35 | 2.70 | 0.010 | 0.003 | 0.025 | 0.0030 | 0.004 | — | 3.05 | 0.13 |

| | Production conditions | | | | | | | | |
|---|---|---|---|---|---|---|---|---|---|
| Ex. no. | Thickness after hot rolling [mm] | Coiling temp. [° C.] | Cold rolled reduction [%] | Grinding (heavy grinding brush) | Annealing temp. [° C.] | Dew point | Holding time [s] | Plating type | Plating deposition [g/m$^2$] |
| 101 | 2.0 | 560 | 80 | Yes | 800 | −5 | 70 | Alloyed | 49 |
| 102 | 2.0 | 600 | 80 | Yes | 800 | −5 | 70 | Alloyed | 50 |
| 103 | 1.8 | 570 | 72 | Yes | 780 | −5 | 65 | Alloyed | 47 |
| 104 | 1.6 | 580 | 0 | Yes | 780 | −5 | 65 | Alloyed | 48 |
| 105 | 2.0 | 580 | 80 | Yes | 800 | −5 | 70 | Alloyed | 48 |
| 106 | 2.0 | 560 | 80 | Yes | 780 | −5 | 70 | Alloyed | 47 |
| 107 | 2.3 | 580 | 80 | Yes | 800 | −5 | 70 | Alloyed | 48 |
| 108 | 2.2 | 580 | 77 | Yes | 780 | −5 | 65 | Alloyed | 48 |
| 109 | 2.2 | 570 | 82 | Yes | 800 | −5 | 70 | Alloyed | 47 |
| 110 | 2.2 | 590 | 82 | Yes | 780 | −5 | 70 | Alloyed | 46 |
| 111 | 2.2 | 580 | 82 | Yes | 780 | −5 | 70 | Alloyed | 50 |
| 112 | 2.0 | 560 | 80 | Yes | 800 | −5 | 70 | Alloyed | 48 |
| 113 | 2.0 | 580 | 80 | Yes | 800 | −5 | 70 | Alloyed | 51 |
| 114 | 2.5 | 600 | 64 | Yes | 800 | −5 | 70 | Alloyed | 50 |
| 115 | 2.3 | 570 | 70 | Yes | 800 | −5 | 70 | Alloyed | 49 |
| 116 | 1.8 | 550 | 83 | Yes | 800 | −5 | 70 | Alloyed | 47 |
| 117 | 1.7 | 580 | 85 | Yes | 800 | −5 | 70 | Alloyed | 49 |
| 118 | 2.3 | 580 | 80 | Yes | 800 | −5 | 70 | Alloyed | 50 |
| 119 | 2.0 | 570 | 80 | Yes | 800 | −5 | 70 | Alloyed | 48 |
| 120 | 1.8 | 560 | 78 | Yes | 800 | −50 | 70 | Alloyed | 47 |
| 121 | 2.0 | 560 | 80 | Yes | 800 | −20 | 70 | Alloyed | 50 |
| 122 | 2.0 | 580 | 80 | Yes | 800 | 5 | 100 | Alloyed | 49 |
| 123 | 2.0 | 590 | 80 | Yes | 800 | −50 | 70 | Alloyed | 50 |
| 124 | 2.0 | 590 | 80 | Yes | 800 | −20 | 130 | Alloyed | 48 |

TABLE 1-continued

| | | | | | | | | | |
|---|---|---|---|---|---|---|---|---|---|
| 125 | 2.0 | 550 | 80 | Yes | 800 | −5 | 70 | Alloyed | 49 |
| 126 | 2.0 | 570 | 80 | Yes | 800 | −5 | 70 | Hot dip galvanized | 47 |
| 127 | 2.0 | 570 | 80 | Yes | 800 | −5 | 500 | Alloyed | 50 |
| 128 | 2.8 | 570 | 64 | Yes | 800 | −5 | 70 | Alloyed | 47 |

TABLE 2

| | Properties | | | | | Evaluation | | |
|---|---|---|---|---|---|---|---|---|
| Ex. no. | Internal oxide layer thickness A [μm] | Decarburized layer thickness B [μm] | Thickness "t" [μm] | A/B | B/t | Tensile strength [MPa] | Plateability | Remarks |
| 101 | 5.0 | 45 | 400 | 0.11 | 0.113 | 612 | Very good | Ex. |
| 102 | 4.5 | 40 | 400 | 0.11 | 0.100 | 630 | Very good | Ex. |
| 103 | 5.0 | 35 | 500 | 0.14 | 0.070 | 1475 | Very good | Ex. |
| 104 | 5.0 | 25 | 1600 | 0.20 | 0.016 | 2410 | — | Comp. ex. |
| 105 | 4.5 | 40 | 400 | 0.11 | 0.100 | 624 | Very good | Ex. |
| 106 | 7.0 | 55 | 400 | 0.13 | 0.138 | 685 | Very good | Ex. |
| 107 | 4.0 | 55 | 450 | 0.07 | 0.122 | 713 | Very good | Ex. |
| 108 | 6.0 | 60 | 500 | 0.10 | 0.120 | 1406 | Very good | Ex. |
| 109 | 3.5 | 50 | 400 | 0.07 | 0.125 | 420 | Very good | Comp. ex. |
| 110 | 3.5 | 45 | 400 | 0.08 | 0.113 | 919 | Poor | Comp. ex. |
| 111 | 2.5 | 75 | 400 | 0.03 | 0.188 | 821 | Good | Ex. |
| 112 | 2.0 | 50 | 400 | 0.04 | 0.125 | 640 | Very good | Ex. |
| 113 | 3.0 | 50 | 400 | 0.06 | 0.125 | 455 | Very good | Comp. ex. |
| 114 | 2.0 | 45 | 900 | 0.04 | 0.050 | 618 | Very good | Ex. |
| 115 | 6.0 | 40 | 700 | 0.15 | 0.057 | 632 | Very good | Ex. |
| 116 | 5.5 | 45 | 300 | 0.12 | 0.150 | 625 | Very good | Ex. |
| 117 | 6.0 | 40 | 250 | 0.15 | 0.160 | 615 | Very good | Ex. |
| 118 | 6.0 | 40 | 450 | 0.15 | 0.089 | 627 | Very good | Ex. |
| 119 | 2.5 | 45 | 400 | 0.06 | 0.113 | 665 | Poor | Comp. ex. |
| 120 | 0.0 | 0 | 400 | — | 0.000 | 752 | Poor | Comp. ex. |
| 121 | 2.0 | 20 | 400 | 0.10 | 0.050 | 723 | Very good | Ex. |
| 122 | 12.0 | 60 | 400 | 0.20 | 0.150 | 669 | Very good | Ex. |
| 123 | 0.0 | 0 | 400 | — | 0.000 | 711 | Poor | Comp. ex. |
| 124 | 2.0 | 30 | 400 | 0.07 | 0.075 | 688 | Very good | Ex. |
| 125 | 5.0 | 40 | 400 | 0.13 | 0.100 | 746 | Very good | Ex. |
| 126 | 6.0 | 40 | 400 | 0.15 | 0.100 | 640 | Very good | Ex. |
| 127 | 12.0 | 85 | 400 | 0.14 | 0.213 | 533 | Very good | Comp. ex. |
| 128 | 5.0 | 30 | 1000 | 0.17 | 0.030 | 1220 | — | Comp. ex. |

Referring to Tables 1 and 2, in Example No. 104, the C content was excessive, therefore the strength of the steel sheet became too high, cold rolling could not be performed, and a suitable sheet thickness could not be obtained. In Example No. 109, the C content was low, therefore the tensile strength fell. In Example No. 110, the Si content was excessive, therefore deterioration of the surface properties was caused and as a result the plateability fell. In Example No. 113, the Mn content was low, therefore the tensile strength fell. In Example No. 119, the Al content was excessive, therefore deterioration of the surface properties was caused and as a result the plateability fell. In Example Nos. 120 and 123, the dew points at the time of annealing were low, therefore internal oxide layers and decarburized layers were not formed and sufficient plateabilities could not be obtained. In Example No. 127, the annealing time was long, therefore the decarburized layer was excessively formed compared with the internal oxide layer and the B/t became high, therefore as a result the tensile strength fell. In Example No. 128, the sheet after hot rolling was thick, therefore the load at the time of the cold rolling step became great and a suitable sheet thickness could not be obtained. In contrast to this, in all examples according to the present invention, by suitably controlling the chemical composition of the steel sheet, the ratio (A/B) of the thickness of the internal oxide layer and the thickness of the decarburized layer of the steel sheet surface, and the ratio (B/t) of the thickness of the decarburized layer and the thickness of the steel sheet, it was possible to achieve sufficient strength and plateability. In particular, in Example Nos. 101 to 103, 105 to 108, 112, 114 to 118, 121, 122, and 124 to 126 where the sum (Si+Mn) of the Si content and Mn content was controlled to 5.00% or less and the ratio (Si/Mn) of the Si content to the Mn content was controlled to 1.50 or less, an extremely high plateability could be realized.

Example B: Production of Broad Width Galvanized Steel Sheet

In the present example, a galvanized steel sheet comprised of steel sheet of a thickness of 0.10 to 0.95 mm (100 to 950 μm) and a width of 1500 to 3000 mm which was galvanized was produced. First, molten steel adjusted in chemical composition was cast to form a steel slab, the steel slab was cooled once, then reheated, the steel slab was hot rolled by a rolling reduction of 50% or more using as a hot rolling lubrication oil a lubrication oil containing Ca sulfonate, the obtained hot rolled steel sheet was coiled up, and the obtained hot rolled coil was stored by the method of storage shown in Table 3. In all of the examples, the heating temperature of the steel slab at the time of reheating was 1200° C. and the finish rolling temperature was 850° C. Any use of lubrication oil containing Ca sulfonate, the thickness after hot rolling, and the coiling temperature were as described in Table 3. After that, the hot rolled coil was pickled using hydrochloric acid and the surface scale was removed down to 0.2 μm or less. After pickling, the steel sheet was cold rolled by the cold rolling reduction described in Table 3. From each cold rolled steel sheet, a sample was taken by the method based on JIS G0417: 1999 and was analyzed for the chemical composition of the steel sheet. Further, five locations of any part of the cold rolled steel sheet were measured for the thickness of the steel sheet by a micrometer. These values were averaged to calculate the sheet thickness. Further, the sheet width was measured using a tape measure. The chemical composition of the steel sheet, sheet thickness, and sheet width of each example are shown in Tables 3 and 4.

Next, each cold rolled steel sheet was ground by 2 g/m$^2$ or more per surface in total for all of the heavy duty grinding brushes using the number of heavy duty grinding brushes shown in Table 3 (the number when deeming a pair of heavy duty grinding brushes arranged above and below a steel sheet as one) in a grinding zone provided at a front of a continuous plating line, then was annealed and hot dip galvanized and, with the exception of No. 21, was further alloyed. In Table 3, samples which were alloyed after hot dip galvanization were indicated as "alloyed" while samples which were not alloyed after hot dip galvanization were indicated as "hot dip galvanized". The temperatures in the annealing, dew points, and holding times were as described in Table 3. The rates of temperature rise up to the annealing temperature were 10° C./s. Further, the annealing atmospheres were hydrogen 3% and nitrogen 97% reducing atmospheres controlled in dew points to oxygen potentials found by formula: $\log(P_{H_2O}/P_{H_2})$ of −3.0 to −1.0. The hot dip galvanization was performed by stopping the cooling after annealing at 480° C., dipping the cold rolled steel sheet in a hot dip galvanization bath for 3 seconds, then adjusting the amount of plating deposition to about 50 g/m$^2$ per surface. In Example Nos. 201 to 220 and 222 to 225, the sheets were alloyed at 550° C. after hot dip galvanization. In all of the examples, the plating layer contained Fe: 5 to 15% and Al: 0.01 to 1%.

(Measurement of Thickness A of Internal Oxide Layer and Calculation of Variation "a" (μm) of that Thickness)

The plating layer of each example was removed by chemically dissolving it in a hydrochloric acid solution to which an inhibitor was added, then a high frequency type GDS was used to analyze the composition in the thickness direction of the steel sheet to evaluate the thickness of the internal oxide layer. Specifically, the sputter depth after sputtering for a certain time from the steel sheet surface in the direction of the thickness of the steel sheet was measured by a laser microscope and the sputter rate per time was calculated. The position where an Mn signal strength of 0.9 time the Mn signal strength of the steel material is reached was identified and the sputter time for reaching that position was converted to depth by the sputter rate. This was deemed the thickness of the internal oxide layer. The above operation was performed for nine points in the width direction of the steel sheet (center, 100 mm positions from two edges, and three points each dividing the span between the edges and center into four) or a total of 18 locations at the two surfaces. The thicknesses found at the different locations were averaged to obtain the thickness A (μm) of the internal oxide layer (per side). Further, the standard deviation was calculated to obtain the standard deviation "a" (μm) at the thickness of the internal oxide layer.

(Measurement of Thickness B of Decarburized Layer and Calculation of Variation "b" (μm) of that Thickness)

The plating layer of each example was removed by being chemically dissolved in a hydrochloric acid solution to which an inhibitor was added, then the hardness distribution in the cross-section of the steel sheet was measured to evaluate the thickness of the decarburized layer. Specifically, the steel sheet was made to corrode by 2% Nital to thereby examine the steel sheet microstructure, the thickness of the decarburized layer was gauged, then the Vickers hardness of the cross-section was measured every 5 μm from the steel sheet surface (interface of steel sheet and plating layer) in the thickness direction. The measurement length was 100 μm. The position where the hardness distribution reached the hardness of the steel sheet was identified and that position was deemed the thickness of the decarburized layer. In the same way as the internal oxide layer, the measurement was performed at nine points, a total of 18 locations at the two sides, and the average value and standard deviation were calculated to obtain the thickness B (μm) of the decarburized layer (per surface) and the standard deviation "b" (μm) in the width direction of the thickness of the decarburized layer in the present invention. The load at the time of measurement of the Vickers hardness was 25 gf.

(Evaluation of Tensile Strength)

A tensile test was performed using a JIS No. 5 tensile test piece by the method prescribed in JIS-Z2241: 2011. The crosshead test speed of the tensile test was 30 mm/min. The obtained results are shown in Table 4. Further, the tensile test was performed by measurement at nine points in the same way as the internal oxide layer. The average value was deemed the tensile strength according to the present invention.

(Evaluation of Plateability)

The plateability was evaluated by the same criteria as the case of Example A.

(Evaluation of Plateability after Imparting 5% Stress)

Steel sheet with a plateability evaluated as "very good" or "good" was further sampled at the same position as where the tensile test piece was taken and evaluated for appearance after imparting 5% stress by tension. Sometimes even if no uneven appearance could be observed before tension, uneven appearance would occur after tension. Steel sheet where no uneven appearance occurred in all samples was evaluated as "good" and one where uneven appearance occurred was evaluated as "poor".

In this example, in the same way as the case of Example A, if the tensile strength is 550 to 1500 MPa and the evaluation of the plateability (except evaluation of plateability after imparting 5% stress) is "very good" or "good", the galvanized steel sheet was evaluated as having sufficient strength and plateability.

TABLE 3

| | Chemical composition of steel sheet [mass %]: balance Fe and impurities | | | | | | | | | | |
|---|---|---|---|---|---|---|---|---|---|---|---|
| Ex. no. | C | Si | Mn | P | S | Al | N | O | Others | Si + Mn | Si/Mn |
| 201 | 0.03 | 0.45 | 1.35 | 0.015 | 0.003 | 0.021 | 0.0027 | 0.003 | — | 1.80 | 0.33 |
| 202 | 0.09 | 0.45 | 1.54 | 0.012 | 0.003 | 0.025 | 0.003 | 0.003 | — | 1.99 | 0.29 |

TABLE 3-continued

| | | | | | | | | | | | |
|---|---|---|---|---|---|---|---|---|---|---|---|
| 203 | 0.21 | 0.42 | 1.10 | 0.011 | 0.003 | 0.023 | 0.003 | 0.002 | Ni: 0.05, Cu: 0.02 | 1.52 | 0.38 |
| 204 | 0.10 | 0.04 | 1.53 | 0.011 | 0.002 | 0.310 | 0.002 | 0.003 | Ti: 0.02, W: 0.02 | 1.57 | 0.03 |
| 205 | 0.07 | 0.86 | 1.25 | 0.009 | 0.002 | 0.026 | 0.003 | 0.003 | Nb: 0.02 | 2.11 | 0.69 |
| 206 | 0.08 | 2.54 | 1.64 | 0.008 | 0.002 | 0.025 | 0.003 | 0.003 | B: 0.0015 | 4.18 | 1.55 |
| 207 | 0.09 | 3.22 | 3.11 | 0.008 | 0.002 | 0.029 | 0.003 | 0.003 | — | 6.33 | 1.04 |
| 208 | 0.08 | 0.45 | 0.74 | 0.012 | 0.003 | 0.027 | 0.003 | 0.004 | — | 1.19 | 0.61 |
| 209 | 0.09 | 0.45 | 2.30 | 0.010 | 0.002 | 0.031 | 0.003 | 0.003 | V: 0.02, Ca: 0.01 | 2.75 | 0.20 |
| 210 | 0.10 | 0.13 | 1.28 | 0.010 | 0.002 | 1.130 | 0.003 | 0.003 | Cr: 0.34, Mo: 0.08 | 1.41 | 0.10 |
| 211 | 0.09 | 0.13 | 1.30 | 0.010 | 0.002 | 2.250 | 0.003 | 0.002 | — | 1.43 | 0.10 |
| 212 | 0.09 | 0.45 | 1.54 | 0.012 | 0.003 | 0.025 | 0.003 | 0.003 | — | 1.99 | 0.29 |
| 213 | 0.10 | 0.04 | 1.53 | 0.011 | 0.002 | 0.310 | 0.002 | 0.003 | Ti: 0.02, W: 0.02 | 1.57 | 0.03 |
| 214 | 0.10 | 0.04 | 1.53 | 0.011 | 0.002 | 0.310 | 0.002 | 0.003 | Ti: 0.02, W: 0.02 | 1.57 | 0.03 |
| 215 | 0.10 | 0.04 | 1.53 | 0.011 | 0.002 | 0.310 | 0.002 | 0.003 | Ti: 0.02, W: 0.02 | 1.57 | 0.03 |
| 216 | 0.09 | 0.45 | 1.53 | 0.012 | 0.002 | 0.023 | 0.003 | 0.003 | Mg: 0.01, Zr: 0.02 | 1.98 | 0.29 |
| 217 | 0.10 | 0.04 | 1.53 | 0.011 | 0.002 | 0.310 | 0.002 | 0.003 | Ti: 0.02, W: 0.02 | 1.57 | 0.03 |
| 218 | 0.10 | 0.04 | 1.53 | 0.011 | 0.002 | 0.310 | 0.002 | 0.003 | Ti: 0.02, W: 0.02 | 1.57 | 0.03 |
| 219 | 0.10 | 0.04 | 1.51 | 0.011 | 0.002 | 0.310 | 0.002 | 0.003 | Hf: 0.01 | 1.55 | 0.03 |
| 220 | 0.10 | 0.04 | 1.53 | 0.010 | 0.003 | 0.300 | 0.003 | 0.003 | REM: 0.03 | 1.57 | 0.03 |
| 221 | 0.09 | 0.45 | 1.54 | 0.012 | 0.003 | 0.025 | 0.003 | 0.003 | — | 1.99 | 0.29 |
| 222 | 0.10 | 2.44 | 2.85 | 0.013 | 0.002 | 0.025 | 0.002 | 0.004 | — | 5.29 | 0.86 |
| 223 | 0.09 | 0.45 | 1.54 | 0.012 | 0.003 | 0.025 | 0.003 | 0.003 | — | 1.99 | 0.29 |
| 224 | 0.09 | 0.45 | 1.54 | 0.012 | 0.003 | 0.025 | 0.003 | 0.003 | — | 1.99 | 0.29 |
| 225 | 0.09 | 0.45 | 1.54 | 0.012 | 0.003 | 0.025 | 0.003 | 0.003 | — | 1.99 | 0.29 |

| | Production conditions | | | | | | | | | | |
|---|---|---|---|---|---|---|---|---|---|---|---|
| Ex. no. | Ca sulfonate-containing lubrication oil | Thickness after hot rolling [mm] | Coiling temp. [° C.] | Hot rolled coil storage method | Cold rolling reduction [%] | No. of heavy grinding brushes [No.] | Annealing temp. [° C.] | Dew point [° C.] | Holding time [s] | Plating type | Plating deposition [g/m$^2$] |
| 201 | Yes | 2.00 | 560 | Hole hor. | 80 | 4 | 811 | −7 | 70 | Alloyed | 48 |
| 202 | Yes | 1.80 | 550 | Hole hor. | 78 | 4 | 785 | −7 | 70 | Alloyed | 48 |
| 203 | Yes | 1.80 | 580 | Hole hor. | 78 | 4 | 780 | −7 | 70 | Alloyed | 48 |
| 204 | Yes | 2.00 | 580 | Hole hor. | 80 | 4 | 780 | −7 | 70 | Alloyed | 47 |
| 205 | Yes | 2.00 | 590 | Hole hor. | 80 | 4 | 790 | −7 | 70 | Alloyed | 49 |
| 206 | Yes | 2.00 | 580 | Hole hor. | 80 | 4 | 780 | −7 | 70 | Alloyed | 50 |
| 207 | Yes | 1.80 | 600 | Hole hor. | 78 | 4 | 780 | −7 | 70 | Alloyed | 48 |
| 208 | Yes | 1.80 | 580 | Hole hor. | 78 | 4 | 790 | −7 | 70 | Alloyed | 46 |
| 209 | Yes | 1.80 | 590 | Hole hor. | 78 | 4 | 790 | −7 | 70 | Alloyed | 47 |
| 210 | Yes | 1.80 | 570 | Hole hor. | 78 | 4 | 780 | −7 | 70 | Alloyed | 48 |
| 211 | Yes | 2.00 | 580 | Hole hor. | 80 | 4 | 780 | −7 | 70 | Alloyed | 46 |
| 212 | Yes | 2.40 | 570 | Hole hor. | 71 | 4 | 780 | −7 | 90 | Alloyed | 47 |
| 213 | Yes | 2.00 | 600 | Hole hor. | 80 | 1 | 780 | −7 | 70 | Alloyed | 46 |
| 214 | Yes | 1.80 | 580 | Hole hor. | 78 | 2 | 780 | −7 | 70 | Alloyed | 46 |
| 215 | Yes | 1.80 | 570 | Hole hor. | 78 | 3 | 780 | −7 | 70 | Alloyed | 46 |
| 216 | Yes | 1.80 | 570 | Hole hor. | 78 | 4 | 780 | −7 | 70 | Alloyed | 48 |
| 217 | Yes | 1.80 | 570 | Hole hor. | 78 | 4 | 780 | 0 | 70 | Alloyed | 48 |
| 218 | Yes | 1.80 | 580 | Hole hor. | 78 | 4 | 780 | −7 | 100 | Alloyed | 48 |
| 219 | Yes | 2.00 | 580 | Hole hor. | 80 | 4 | 790 | −7 | 70 | Alloyed | 49 |
| 220 | Yes | 2.00 | 590 | Hole hor. | 80 | 4 | 790 | −7 | 70 | Alloyed | 49 |
| 221 | Yes | 2.00 | 580 | Hole hor. | 80 | 4 | 785 | −7 | 70 | Hot dip galvanized | 50 |
| 222 | Yes | 2.00 | 580 | Hole hor. | 80 | 4 | 780 | −5 | 70 | Alloyed | 48 |
| 223 | No | 2.00 | 570 | Hole hor. | 80 | 4 | 780 | −7 | 70 | Alloyed | 48 |
| 224 | Yes | 2.00 | 570 | Hole ver. | 80 | 4 | 780 | −7 | 70 | Alloyed | 49 |
| 225 | Yes | 2.00 | 620 | Hole hor. | 80 | 4 | 780 | −7 | 70 | Alloyed | 49 |

TABLE 4

| | Properties | | | | | | | | | | Evaluation | | | |
|---|---|---|---|---|---|---|---|---|---|---|---|---|---|---|
| Ex. no. | Internal oxide layer thickness A [μm] | Decarburized layer thickness B [μm] | Internal oxide layer standard deviation "a" [μm] | Decarburized layer standard deviation "b" μm] | Thickness [μm] | Sheet width [mm] | A/B | B/t | a/A | b/B | Tensile strength [MPa] | Plateability | Plateability after imparting 5% stress | Remarks |
| 201 | 3.1 | 22 | 0.20 | 3.10 | 400 | 1850 | 0.14 | 0.055 | 0.06 | 0.14 | 420 | Very good | Good | Comp. ex. |
| 202 | 2.5 | 58 | 0.25 | 10.10 | 400 | 1850 | 0.04 | 0.145 | 0.10 | 0.17 | 575 | Very good | Good | Ex. |
| 203 | 3.0 | 42 | 0.33 | 6.90 | 400 | 1850 | 0.07 | 0.105 | 0.11 | 0.16 | 1199 | Very good | Good | Ex. |
| 204 | 2.5 | 63 | 0.19 | 8.50 | 400 | 1850 | 0.04 | 0.158 | 0.08 | 0.13 | 625 | Very good | Good | Ex. |
| 205 | 3.5 | 69 | 0.45 | 7.60 | 400 | 1850 | 0.05 | 0.173 | 0.13 | 0.11 | 688 | Very good | Good | Ex. |
| 206 | 5.1 | 77 | 0.54 | 11.00 | 400 | 1850 | 0.07 | 0.193 | 0.11 | 0.14 | 842 | Good | Good | Ex. |
| 207 | 6.5 | 78 | 0.81 | 10.50 | 400 | 1850 | 0.08 | 0.195 | 0.12 | 0.13 | 1155 | Poor | — | Comp. ex. |
| 208 | 2.7 | 47 | 0.31 | 6.70 | 400 | 1850 | 0.06 | 0.118 | 0.11 | 0.14 | 494 | Very good | Good | Comp. ex. |
| 209 | 3.1 | 50 | 0.40 | 8.10 | 400 | 1850 | 0.06 | 0.125 | 0.13 | 0.16 | 685 | Very good | Good | Ex. |
| 210 | 2.1 | 47 | 0.23 | 5.40 | 400 | 1850 | 0.04 | 0.118 | 0.11 | 0.11 | 723 | Very good | Good | Ex. |
| 211 | 2.1 | 45 | 0.29 | 6.00 | 400 | 1850 | 0.05 | 0.113 | 0.14 | 0.13 | 635 | Poor | — | Comp. ex. |
| 212 | 3.0 | 65 | 0.37 | 11.00 | 700 | 1850 | 0.05 | 0.093 | 0.12 | 0.17 | 580 | Very good | Good | Ex. |
| 213 | 2.3 | 55 | 0.50 | 11.30 | 400 | 1850 | 0.04 | 0.138 | 0.22 | 0.21 | 630 | Good | Poor | Ex. |
| 214 | 2.7 | 60 | 0.40 | 12.60 | 400 | 1850 | 0.05 | 0.150 | 0.15 | 0.21 | 624 | Good | Poor | Ex. |
| 215 | 3.0 | 63 | 0.26 | 9.40 | 400 | 1850 | 0.05 | 0.158 | 0.09 | 0.15 | 629 | Good | Good | Ex. |
| 216 | 2.8 | 65 | 0.38 | 9.10 | 400 | 2160 | 0.04 | 0.163 | 0.14 | 0.14 | 630 | Very good | Good | Ex. |
| 217 | 3.0 | 65 | 0.37 | 8.50 | 400 | 1850 | 0.05 | 0.163 | 0.12 | 0.13 | 620 | Very good | Good | Ex. |
| 218 | 3.3 | 72 | 0.45 | 9.00 | 400 | 1850 | 0.05 | 0.180 | 0.14 | 0.13 | 610 | Very good | Good | Ex. |
| 219 | 3.5 | 67 | 0.49 | 7.50 | 400 | 1530 | 0.05 | 0.168 | 0.14 | 0.11 | 640 | Very good | Good | Ex. |
| 220 | 2.9 | 65 | 0.37 | 8.20 | 400 | 1530 | 0.04 | 0.163 | 0.13 | 0.13 | 638 | Very good | Good | Ex. |
| 221 | 2.8 | 60 | 0.27 | 9.80 | 400 | 1850 | 0.05 | 0.150 | 0.10 | 0.16 | 581 | Very good | Good | Ex. |
| 222 | 5.9 | 71 | 0.46 | 9.80 | 400 | 1850 | 0.08 | 0.178 | 0.08 | 0.14 | 954 | Good | Good | Ex. |
| 223 | 2.5 | 55 | 0.50 | 12.00 | 400 | 1850 | 0.05 | 0.138 | 0.20 | 0.22 | 575 | Very good | Poor | Ex. |
| 224 | 2.5 | 53 | 0.33 | 13.00 | 400 | 1850 | 0.05 | 0.133 | 0.13 | 0.25 | 575 | Very good | Poor | Ex. |
| 225 | 2.5 | 83 | 0.55 | 13.50 | 400 | 1850 | 0.03 | 0.208 | 0.22 | 0.16 | 540 | Very good | Poor | Comp. ex. |

Referring to Tables 3 and 4, in Example No. 201, the C content was low, therefore the tensile strength fell. In Example No. 207, the Si content was high, therefore deterioration of the surface properties was caused and as a result the plateability fell. In Example No. 208, the Mn content was low, therefore the tensile strength fell. In Example No. 211, the Al content was high, therefore deterioration of the surface properties was caused and as a result the plateability fell. In Example No. 225, the coiling temperature was high, therefore it was not possible to sufficiently suppress the formation of the decarburized layer at the hot rolling step and as a result B/t became higher and the tensile strength fell.

In contrast to this, in all of the examples according to the present invention, by suitably controlling the chemical composition of the steel sheet, the ratio (A/B) of the thickness of the internal oxide layer and the thickness of the decarburized layer of the steel sheet surface, and the ratio (B/t) of the thickness of the decarburized layer and the thickness of the steel sheet, it was possible to achieve sufficient strength and plateability. In particular, in Example Nos. 202 to 206, 209, 210, 212, and 215 to 222 sufficiently controlling the chemical composition of the steel sheet, A/B, and B/t and also the thickness (A) of the internal oxide layer of the steel sheet surface, the thickness (B) of the decarburized layer, and the variations (a/A and b/B) of these in the width direction, no uneven appearance occurred even after imparting 5% stress, therefore it was possible to achieve sufficient and uniform strength and plateability in the steel sheet as a whole. In the other examples, i.e., in Example Nos. 213, 214, 223, and 224, sufficient strengths and plateabilities could be achieved, but the occurrence of uneven appearance was observed after imparting 5% stress. Specifically, in Example Nos. 213 and 214, the numbers of heavy duty grinding brushes were small, so it is believed the surface roughnesses were not sufficiently made uniform over the width directions of the steel sheets as a whole and stress was not imparted sufficiently uniformly. As a result, the desired a/A and/or b/B were not obtained and uneven appearances occurred after imparting 5% stress. In Example No. 223, suitable hot rolling lubrication oil was not used in the hot rolling step, therefore a/A and b/B became higher and as a result uneven appearance occurred after imparting 5% stress. In Example No. 224, the method of storage of the hot rolled coil after hot rolling and coiling was not suitable, so b/B became high and as a result uneven appearance occurred after imparting 5% stress.

INDUSTRIAL APPLICABILITY

The galvanized steel sheet according to the present invention has sufficient plateability and strength, therefore it becomes possible to provide a high strength galvanized steel sheet excellent in appearance properties. The galvanized steel sheet can be suitably used for automobiles, household electric appliances, building materials, and other applications, in particular for automobile use. Therefore, the present invention can be said to be an invention with an extremely high value in industry.

The invention claimed is:

1. A galvanized steel sheet comprising a steel sheet having a chemical composition containing, by mass %, C: 0.05 to 0.30%, Si: 0.01 to 3.00%, Mn: 0.80 to 3.00%, Al: 0.010 to 2.000%, P: 0.100% or less,
S: 0.100% or less,
N: 0.0300% or less,
O: 0.010% or less,
B: 0 to 0.0100%,
Ti: 0 to 0.100%,
Nb: 0 to 0.100%,
V: 0 to 0.10%,
Cr: 0 to 1.00%,
Ni: 0 to 0.10%,
Cu: 0 to 0.10%,
Mo: 0 to 0.50%,
W: 0 to 0.50%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein the steel sheet has a thickness of 0.10 to 0.95 mm, and
a galvanized layer formed on at least one surface of the steel sheet,
wherein
a tensile strength is 550 to 1500 MPa,
when defining a thickness of an internal oxide layer per surface of the steel sheet as "A" (μm), a thickness of a decarburized layer per surface of the steel sheet as "B" (μm), and the thickness of the steel sheet as "t" (μm),
A/B: 0.01 to 0.50 and
B/t: 0.001 to 0.200,
a width of the steel sheet is 1500 to 3000 mm, and,
when defining a standard deviation in a width direction of a thickness of the internal oxide layer as "a" (μm) and a standard deviation in a width direction of a thickness of the decarburized layer as "b" (μm),
A: 1.0 μm or more,
B: 10 μm or more,
a/A: 0.15 or less, and
b/B: 0.20 or less.

2. The galvanized steel sheet according to claim 1, wherein, by mass %, Si+Mn: 5.00% or less and Si/Mn: 1.50 or less.

3. The galvanized steel sheet according to claim 1, wherein the steel sheet has a chemical composition containing, by mass %, one or more of
B: 0.0001 to 0.0100%,
Ti: 0.001 to 0.100%,
Nb: 0.001 to 0.100%,
Cr: 0.01 to 1.00%,
Mo: 0.01 to 0.50%, and
W: 0.01 to 0.50%.

4. The galvanized steel sheet according to claim 1, wherein the steel sheet has a chemical composition containing, by mass %, one or more of
V: 0.01 to 0.10%,
Ni: 0.01 to 0.10%,
Cu: 0.01 to 0.10%,
Ca: 0.001 to 0.100%,
Mg: 0.001 to 0.100%,
Zr: 0.001 to 0.100%,
Hf: 0.001 to 0.100%, and
REM: 0.001 to 0.100%.

5. The galvanized steel sheet according to claim 1, wherein the galvanized steel sheet is a hot dip galvannealed steel sheet, a chemical composition of the galvanized layer contains, by mass %, Fe: 5 to 15%, Al: 0.01 to 1% and a balance of Zn and impurities, and an amount of deposition per surface of the galvanized layer is 10 to 100 g/m$^2$.

6. The galvanized steel sheet according to claim 2, wherein the steel sheet has a chemical composition containing, by mass %, one or more of
B: 0.0001 to 0.0100%,
Ti: 0.001 to 0.100%,
Nb: 0.001 to 0.100%,
Cr: 0.01 to 1.00%,
Mo: 0.01 to 0.50%, and
W: 0.01 to 0.50%.

7. The galvanized steel sheet according to claim 2, wherein the steel sheet has a chemical composition containing, by mass %, one or more of
V: 0.01 to 0.10%,
Ni: 0.01 to 0.10%,
Cu: 0.01 to 0.10%,
Ca: 0.001 to 0.100%,
Mg: 0.001 to 0.100%,
Zr: 0.001 to 0.100%,
Hf: 0.001 to 0.100%, and
REM: 0.001 to 0.100%.

8. The galvanized steel sheet according to claim 3, wherein the steel sheet has a chemical composition containing, by mass %, one or more of
V: 0.01 to 0.10%,
Ni: 0.01 to 0.10%,
Cu: 0.01 to 0.10%,
Ca: 0.001 to 0.100%,
Mg: 0.001 to 0.100%,
Zr: 0.001 to 0.100%,
Hf: 0.001 to 0.100%, and
REM: 0.001 to 0.100%.

9. The galvanized steel sheet according to claim 2, wherein the galvanized steel sheet is a hot dip galvannealed steel sheet, a chemical composition of the galvanized layer contains, by mass %, Fe: 5 to 15%, Al: 0.01 to 1% and a balance of Zn and impurities, and an amount of deposition per surface of the galvanized layer is 10 to 100 g/m$^2$.

10. The galvanized steel sheet according to claim 3, wherein the galvanized steel sheet is a hot dip galvannealed steel sheet, a chemical composition of the galvanized layer contains, by mass %, Fe: 5 to 15%, Al: 0.01 to 1% and a balance of Zn and impurities, and an amount of deposition per surface of the galvanized layer is 10 to 100 g/m$^2$.

11. The galvanized steel sheet according to claim 4, wherein the galvanized steel sheet is a hot dip galvannealed steel sheet, a chemical composition of the galvanized layer contains, by mass %, Fe: 5 to 15%, Al: 0.01 to 1% and a balance of Zn and impurities, and an amount of deposition per surface of the galvanized layer is 10 to 100 g/m$^2$.

* * * * *